United States Patent [19]

Skinner

[11] Patent Number: 5,050,681

[45] Date of Patent: Sep. 24, 1991

[54] HYDRAULIC SYSTEM FOR ELECTRONICALLY CONTROLLED PRESSURE ACTIVATED DOWNHOLE TESTING TOOL

[75] Inventor: Neal G. Skinner, Lewisville, Tex.

[73] Assignee: Halliburton Company, Duncan, Okla.

[21] Appl. No.: 551,693

[22] Filed: Jul. 10, 1990

[51] Int. Cl.[5] ..... E21B 34/10

[52] U.S. Cl. ..... 166/374; 166/65.1; 166/66.4; 166/242; 166/319; 166/323

[58] Field of Search ..... 166/65.1, 66.4, 242, 166/250, 373, 374, 319, 323, 324, 264

[56] References Cited

U.S. PATENT DOCUMENTS

| | | | |
|---|---|---|---|
| 3,664,415 | 5/1972 | Wray et al. | 166/0.5 |
| 3,827,491 | 8/1974 | Dinning | 166/242 |
| 3,856,085 | 12/1974 | Holden et al. | 166/264 |
| 4,347,900 | 9/1982 | Barrington | 166/380 |
| 4,375,239 | 3/1983 | Barrington et al. | 166/336 |
| 4,378,850 | 4/1983 | Barrington | 166/373 |
| 4,421,174 | 12/1983 | McStravick et al. | 166/374 |
| 4,422,506 | 12/1983 | Beck | 166/324 |
| 4,444,268 | 4/1984 | Barrington | 166/373 |
| 4,489,786 | 12/1984 | Beck | 166/374 |
| 4,515,219 | 5/1985 | Beck | 166/374 |
| 4,537,258 | 8/1985 | Beck | 166/374 |
| 4,557,333 | 12/1985 | Beck | 166/374 |
| 4,711,305 | 12/1987 | Ringgenberg | 166/336 |
| 4,796,699 | 1/1989 | Upchurch | 166/250 |
| 4,896,722 | 1/1990 | Upchurch | 166/250 |
| 4,915,168 | 4/1990 | Upchurch | 166/250 |

*Primary Examiner*—Bruce M. Kisliuk

*Attorney, Agent, or Firm*—C. Dean Domingue; L. Wayne Beavers

[57] ABSTRACT

An annulus pressure responsive tool is temporarily deactivated so as to no longer be responsive to changes in well annulus pressure. The tool includes a tool housing with a power piston slidably disposed in the housing. A first pressure conducting passage in the housing communicates the well annulus to one side of the power piston. A reference pressure means is disposed in the housing for providing pressure to the second side of the power piston. Thus, a pressure differential is created across the power piston. Also, a selectively operable temporary deactivating means is provided so that the power piston is no longer responsive to changes in the well annulus pressure.

41 Claims, 12 Drawing Sheets

HYDRAULIC SYSTEM FOR ELECTRONICALLY CONTROLLED PRESSURE ACTIVATED DOWNHOLE TESTING TOOL

BACKGROUND OF THE INVENTION

1. Field of the Invention

The present invention relates generally to downhole tools for use in oil or gas wells, and more particularly, but not by way of limitation, to annulus pressure responsive tools which are electronically controlled in response to command signals transmitted as pressure pulses in the well annulus.

2. Description of the Prior Art

U.S. Pat. No. 4,422,506 to Beck, and assigned to the assignee of the present invention, discloses a typical annulus pressure responsive tester valve of the type utilized by the assignee of the present invention and toward which the modifications of the present invention are generally directed. The Beck apparatus includes a housing having a power piston disposed therein. First and second pressure conducting passages are defined in the housing and communicate the well annulus with first and second sides of the power piston. A metering orifice type of retarding means is disposed in the second pressure conducting passage for providing a time delay in communication of changes in well annulus pressure to the second side of the power piston. Accordingly, a rapid increase or rapid decrease in well annulus pressure causes a temporary pressure differential across the piston which moves the piston. The metering orifice functions to define a temporary reference pressure within the tool which is different from the rapidly changed well annulus pressure so as to provide the necessary pressure differential for operation of the tool.

U.S. Pat. No. 4,711,305 to Ringgenberg, and assigned to the assignee of the present invention, discloses another manner for actuating an annulus pressure responsive downhole tool. The Ringgenberg device utilizes a pressurized gas chamber to provide a compressible fluid spring against which the power piston operates in response to changes in well annulus pressure.

The prior art also includes downhole tools which operate in response to command signals sent from the surface. For example, U.S. Pat. No. 4,347,900 to Barrington; U.S. Pat. No. 4,375,239 to Barrington et al.; and U.S. Pat. No. 4,378,850 to Barrington, all disclose downhole tools operated in response to acoustic command signals transmitted down a pipe string.

U.S. Pat. Nos. 4,796,699; 4,896,722; and 4,915,168, all to Upchurch, all disclose downhole tools responsive to command signals transmitted with a pressure pulse down a well annulus.

There is a need for a simplified means for controlling downhole tools in response to remote command signals.

SUMMARY OF THE INVENTION

The present invention provides a downhole tool apparatus which is responsive to changes in well annulus pressure.

The apparatus includes a tool housing having a power piston slidably disposed in the housing. The piston has a first side and a second side.

A first pressure conducting passage means is defined in the housing for communicating the well annulus with the first side of the power piston.

A reference pressure means is disposed in the housing for providing a reference pressure communicated with the second side of the power piston so that a change in well annulus pressure creates a pressure differential across the power piston to move the power piston between a first position and a second position relative to the housing.

A selectively operable deactivating means is provided for temporarily deactivating the power piston so that the power piston is no longer responsive to changes in well annulus pressure.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
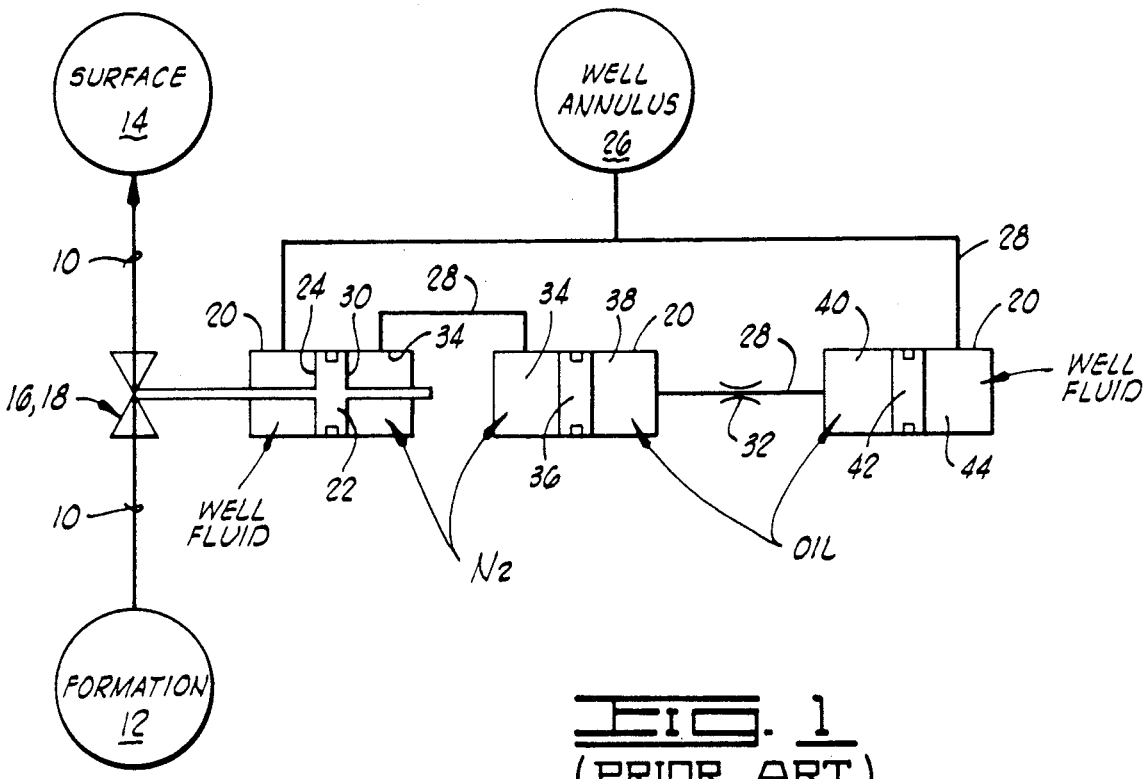
FIG. 1 (PRIOR ART)
FIG. 1 is a schematic illustration of a typical prior art annulus pressure responsive downhole tool.
Figure 3:
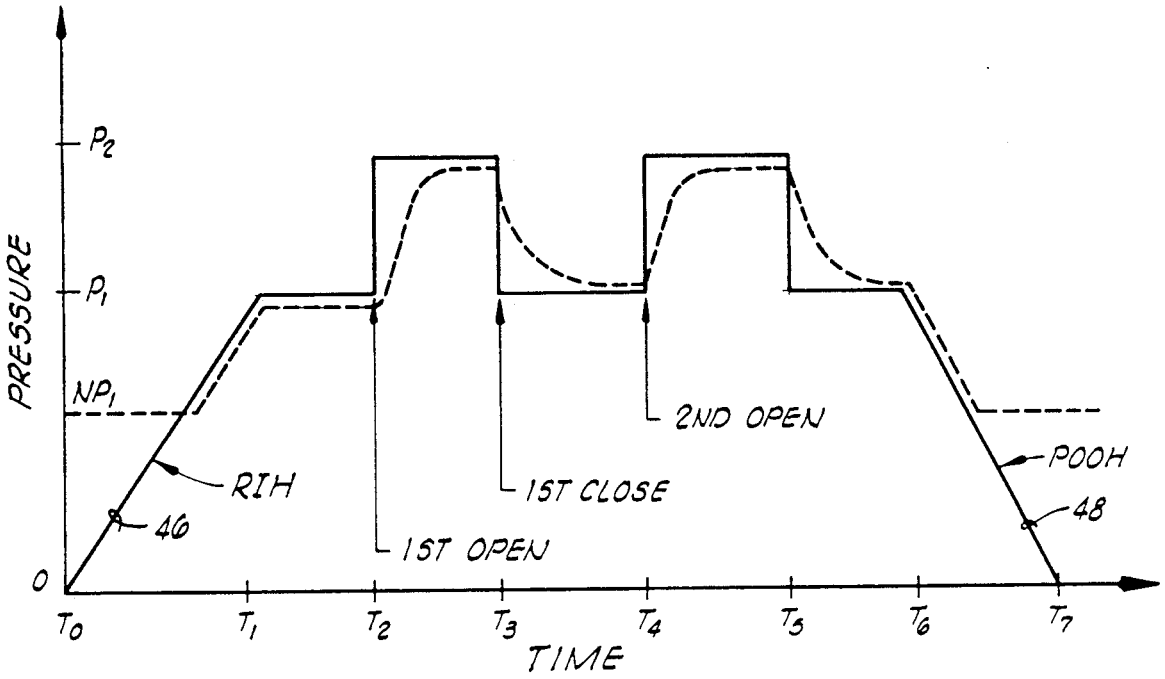
FIG. 3 (PRIOR ART)
FIG. 3 is a graph of annulus and nitrogen pressure during a typical operation of a prior art tool like that of FIG. 1.

The Prior Art Tool of FIGS. 1 and 3

FIG. 1 is a hydraulic schematic illustration of one typical form of prior art annulus pressure responsive tool, corresponding generally to the tool set forth in U.S. Pat. No. 4,422,506 to Beck.

A well test string 10 is schematically illustrated as extending from a subsurface formation 12 up to the earth's surface 14. A downhole tool 16 including a tester valve 18 is disposed in test string 10 for controlling the flow of well fluids from formation 12 up through testing string 10 to the earth's surface 14.

The downhole tool 16 includes a housing 20 in which the valve 18 is disposed. A power piston 22 is disposed in the housing 20. A first side 24 of power piston 22 is communicated with the well annulus 26 so as to be exposed to the fluid pressure present in well annulus 26.

A passage 28 defined through the housing 20 communicates a second side 30 of power piston 22 with the well annulus 26 through a metering means 32.

The second side 30 of power piston 22 is directly exposed to compressed nitrogen gas in a nitrogen chamber 34. A floating piston 36 transfers pressure between nitrogen chamber 34 and a first oil chamber 38. Oil in first oil chamber 38 must flow through the metering means 32 into a second oil chamber 40. A second floating piston 42 transmits pressure between chamber 40 and well fluid contained in a chamber 44 which is directly exposed to the well annulus 26.

In this arrangement when annulus pressure is quickly increased, pressure on first side 24 of power piston 22 increases quickly. At the same time, annulus pressure in oil chamber 40 increases but meters slowly through metering means 32 so that pressure in oil chamber 38 and nitrogen chamber 34 communicated with the second side 30 of power piston 22 increases relatively slowly. This differential pressure results in a large hydraulic force which tends to push the power piston 22 from left to right as shown in FIG. 1 and thus to open the valve 18. As well annulus pressure is maintained at the increased value, oil will continue to meter through metering means 32 into oil chamber 38 and thus the pressure differential across the power piston 22 will approach zero, unless the metering means 32 incorporates back pressure check valves as further described below in reference to FIGS. 9I–9J.

If annulus pressure has been applied for long enough for pressure equalization across the power piston 22 to occur, and pressure in the well annulus 26 is then quickly reduced, the pressure on the first side 24 of power piston 22 is quickly reduced. However, again because of the metering means 32, time is required for the pressure to decrease in the nitrogen chamber 34 communicated with the second side 30 of power piston 22. This results in a large pressure differential across the power piston 22 which will move it from right to left as shown in FIG. 1 and will move the valve 18 back to its original closed position.

FIG. 3 is a graph of annulus pressure and nitrogen pressure versus time during a typical testing procedure carried out with the prior art apparatus of FIG. 1. The pressure in well annulus 26 at the elevation of the tool 16 is shown as a solid line. The pressure within nitrogen chamber 34 is represented by the dashed lines. Beginning at the left end, time $T_0$ represents the initial placement of the tool in the well at the surface. The tool is steadily lowered into the well until time $T_1$ at which time the tool has reached the depth within the well at which it is to be operated. From $T_0$ to $T_1$ the pressure to which the tool 16 is exposed rises along line 46 from zero to $P_1$ which is the hydrostatic pressure in the well annulus 26 at the depth of tool 16.

At time $T_2$ well annulus pressure is rapidly increased to $P_2$ to open the valve 18. Well annulus pressure is maintained at $P_2$ until time $T_3$. The interval from $T_2$ to $T_3$ is sufficient for well annulus pressure to equalize across power piston 22. At time $T_3$ well annulus pressure is reduced rapidly to hydrostatic pressure $P_1$ thus again closing valve 18. Annulus pressure remains at hydrostatic pressure $P_1$ until time $T_4$ at which pressure is again rapidly increased to $P_2$. This again opens valve 18. At $T_5$ pressure is again reduced to hydrostatic pressure and the valve 18 again closes. At time $T_6$ the retrieval of tool 16 out of the well is begun and the tool 16 reaches the surface again at time $T_7$. The decrease in hydrostatic pressure to which tool 16 is exposed between times $T_6$ and $T_7$ is represented by sloped line 48.

The dashed lines in FIG. 3 represent the pressure in nitrogen chamber 34 during this procedure. Pressure begins at $NP_1$ which represents the initial pressurized charge placed in nitrogen chamber 34 when the tool 16 is at the surface. As hydrostatic pressure changes in the manner previously described, the nitrogen pressure lags behind hydrostatic pressure as illustrated in the curve. This lag is due to the use of restricted orifices and back pressure check valves in metering means 32.

The Tool of FIGS. 2 and 9–16

Figure 2:
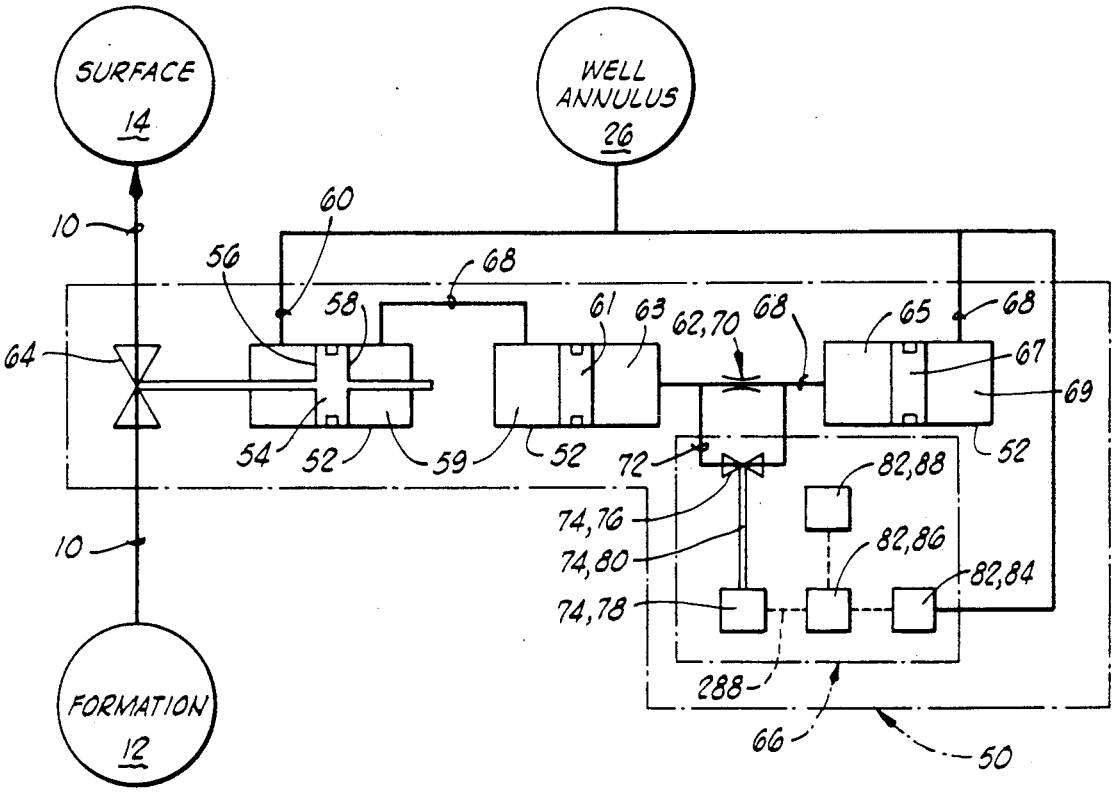
FIG. 2 is a schematic illustration of a downhole tool similar to that of FIG. 1 which has been modified in accordance with the present invention to provide a means for temporarily deactivating the tool.

FIG. 2 is a schematic illustration of the electronically controlled pressure activated hydraulic system of the present invention as utilized to modify a tool generally otherwise similar to the tool 16 of FIG. 1.

In FIG. 2 a downhole tool apparatus 50 is schematically illustrated within the phantom boundaries designated by the numeral 50. The downhole tool 50 is responsive to changes in pressure in the well annulus 26.

The downhole tool 50 includes a tool housing 52. A power piston 54 is slidably disposed in the tool housing 52 and has a first side 56 and a second side 58. The power piston 54 can be generally described as an operating means 54 for operating the tool 50 in response to changes in well annulus pressure.

A first pressure conducting passage means 60 is defined in the housing 52 for communicating the well annulus 26 with the first side 56 of power piston 54.

A reference pressure means generally indicated at 62 is disposed in the tool housing 52 for providing a reference pressure communicated with the second side 58 of the power piston 54 so that a change in well annulus pressure creates a pressure differential across power piston 54 to move the power piston 54 between a first position and a second position relative to the housing 52. The power piston 54 is operably associated with a tester valve 64 disposed in test string 10, and moves the tester valve 64 between closed and open positions as the power piston 54 moves between its first position and second position, respectively.

The tool 50 further includes a selectively operable deactivating means 66 shown within the phantom boundary denoted by numeral 66. The deactivating means 66 provides a means for temporarily deactivating the power piston 54 so that the power piston 54 is no longer responsive to changes in well annulus pressure.

The deactivating means 66 can further be generally described with regard to the tool 50 as a means for balancing well annulus pressure across the power piston 54 to deactivate the power piston 54. The deactivating means 66 can also be described as a means for repeatedly selectively deactivating the power piston 54 so that the power piston 54 is no longer responsive to changes in well annulus pressure and for subsequently reactivating the power piston 54 so that the power piston 54 is again responsive to changes in well annulus pressure.

The tool 50 includes a second pressure conducting passage means 68 defined in housing 52 for communicating the well annulus 26 with the second side 58 of power piston 54. The reference pressure means 62 includes a metering means 70 disposed in the second pressure conducting passage means 68. The metering means 70 can generally be described as a retarding means 70, disposed in the second pressure conducting passage means 68, for delaying communication of a sufficient portion of a change in well annulus pressure to the second side 58 of power piston 54 for a sufficient time to allow a pressure differential across the power piston 54 to move the power piston 54 between its previously mentioned first and second positions relative to housing 52.

The second side 58 of power piston 54 communicates with nitrogen chamber 59. A floating piston 61 transmits pressure between nitrogen chamber 59 and a first oil chamber 63. Fluid from first oil chamber 63 communicates with second oil chamber 65 through the metering means 70. A second floating piston 67 transmits pressure between second oil chamber 65 and well fluid contained in a mud chamber 69.

The deactivating means 66 can be generally described as a selectively operable bypass means 66 for bypassing changes in well annulus pressure around the reference pressure means 62, and particularly around the metering means 70 thereof.

The bypass means 66 has an open position wherein changes in well annulus pressure are substantially immediately communicated with second side 58 of power piston 54 and the power piston 54 is not moved by changes in well annulus pressure. Bypass means 66 also has a closed position wherein the second side 58 of power piston 54 is in operable communication with the reference pressure means 62 and particularly the metering means 70 thereof; that is the pressure changes from well annulus 26 must be transmitted through the metering means 70 in order for those pressure changes to reach the second side 58 of power piston 54 when the bypass means 66 is in its closed position.

The bypass means 66 includes a bypass passage means 72 defined in the housing 52 for communicating the well annulus 26 with the second side 58 of power piston 54. It is seen that the bypass passage means 72 is in hydraulic parallel with that portion of second pressure conducting passage means 68 in which metering means 70 is placed, so that when the bypass passage means 72 is open changes in well annulus pressure will be quickly transmitted therethrough rather than through the more restricted passage through metering means 70.

Bypass means 66 includes an electric motor operated bypass valve means 74 having a valve element 76 disposed in bypass passage 72, and having a motor 78 which operates the valve element 76 through a shaft 80. The bypass valve means 74 is disposed in the bypass passage means 72 for selectively opening and closing the bypass passage means 72 as the valve element 76 is moved between and open and closed position.

The bypass means 66 further includes a control means 82 for moving the bypass valve means 74 between its said open and closed positions. The control means 82 is itself responsive to changes in well annulus pressure. Control means 82 includes a pressure sensor means 84 for detecting changes in well annulus pressure, and a microprocessor means 86 for controlling the electric motor 74 in response to a predetermined change in well annulus pressure as detected by the pressure sensor means 84. Control means 82 also includes an electrical battery power supply 88.

Sensor means 84, microprocessor means 86, electrical battery supply 88, and electric motor 78 are all interconnected by electrical wiring as indicated by dashed lines.

It is noted that the apparatus 50 could also be constructed so that it is deactivated in response to inputs other than an annulus pressure signal. For example, the pressure sensor 84 could be replaced with an acoustic sensor so that the apparatus 50 could be selectively deactivated in response to detection of an acoustic signal. Similarly, a clock could be included in the control means 82 so as to enable or disable the apparatus 50 automatically at predetermined intervals.

The electric motor operated bypass valve means 74 is further characterized as requiring electric power only to selectively move the valve element 76 between its said open and closed positions, so that the valve element 76 will remain in either its open or closed position without continued application of electric power thereto. Furthermore, the microprocessor means 86 is programmed to cause the electric motor control bypass valve means to remain in a predetermined one of its said open and closed positions upon sensing of a low power state of the power supply 88. That is, when the power supplied from power supply 88 declines to a predetermined low level, this is sensed and the microprocessor means is programmed to respond to that condition and to cause the electric motor control bypass valve means 74 to move to a predetermined one of its open and closed positions. The predetermined position which is appropriate depends upon the particular downhole tool. For a tester valve, typically the microprocessor means 86 would be programmed so that the valve element 76 will move to or remain in its closed position so that the reference pressure means 62 is operable and the tester valve 64 will respond to changes in well annulus pressure after the batteries fail.

The microprocessor means 86 is programmed to open and close the electric motor operated bypass valve means 74 in response to predetermined changes in well annulus pressure sensed by sensing means 84. These changes may be two or more pressure pulses, a stepped or multi-level single pulse, or pressure increases or pressure changes corresponding with predetermined times. Thus, the deactivation means 66 can be generally described as being movable between deactivated and reactivated positions thereof in response to predetermined changes in well annulus pressure. The deactivated position of deactivating means 66 is that position corresponding to the open position of valve element 76 wherein the metering means 70 is bypassed. The reactivated position of deactivating means 66 is that position corresponding to the closed position of valve element 76 wherein the time delay effect of the metering means 70 is operable.

FIGS. 9A-9L comprise an elevation, right-side only, detailed sectioned view of the downhole tool 50 which was only schematically shown in FIG. 2.

The tool housing 52 is a cylindrical tool housing 52 which is made up of a number of interconnected components including an upper adapter 88, an upper valve support 90, a valve case 92, a shear pin adapter 94, a power case 96, a nitrogen fill adapter 98, a nitrogen chamber case 100, an inner nitrogen chamber mandrel 101, an oil fill adapter 102, an inner oil chamber mandrel 103, a bypass housing section 104, a mud case 106, and a lower adapter 108.

The upper adapter 88 and upper valve support 90 are connected together at threaded connection 110 with an O-ring seal 112 provided therebetween. Outward extending splines 114 of upper valve support 90 engage inward extending splines 116 of valve case 92. An upward facing shoulder 118 of upper valve support 90 is pressed against the lower end of splines 116 and holds the valve case 92 rigidly against upper adapter 88. An O-ring seal 120 is provided between upper adapter 88 and valve case 92.

The tester valve 64 includes a rotatable hollow ball valve element 122 which is held between upper and lower seats 124 and 126. The upper seat 124 is contained in upper valve support 90, and the lower seat 126 is contained in a lower valve support 128. The lower valve support 128 is connected to upper valve support 90 at thread 129 so that the ball valve member 122 is tightly sandwiched between its upper and lower seats 124 and 126.

Figure 9A:
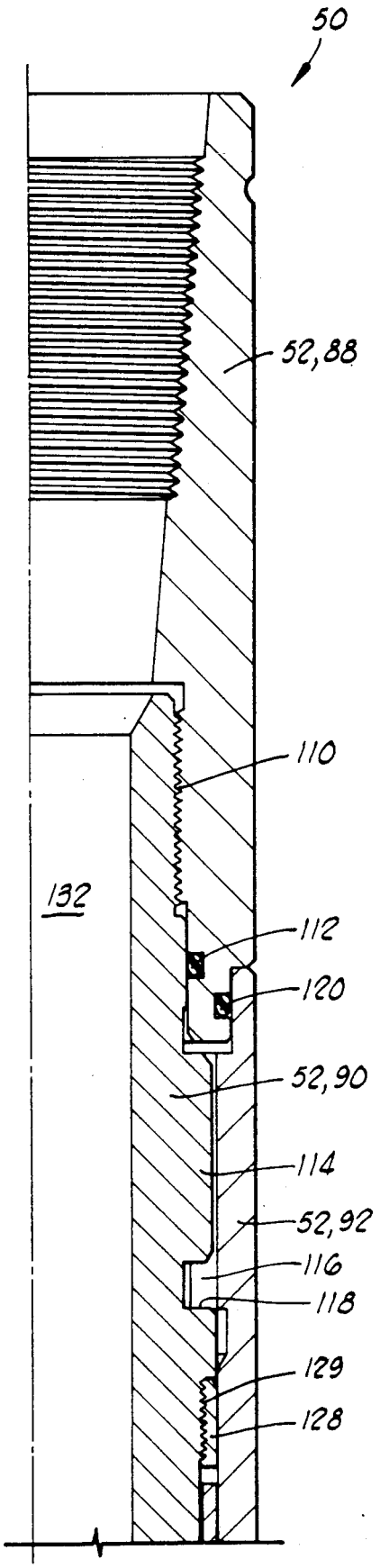
FIGS. 9A–9L comprise an elevation, right-side only, sectioned view of the downhole tool schematically illustrated in FIG. 2.
Figure 9B:
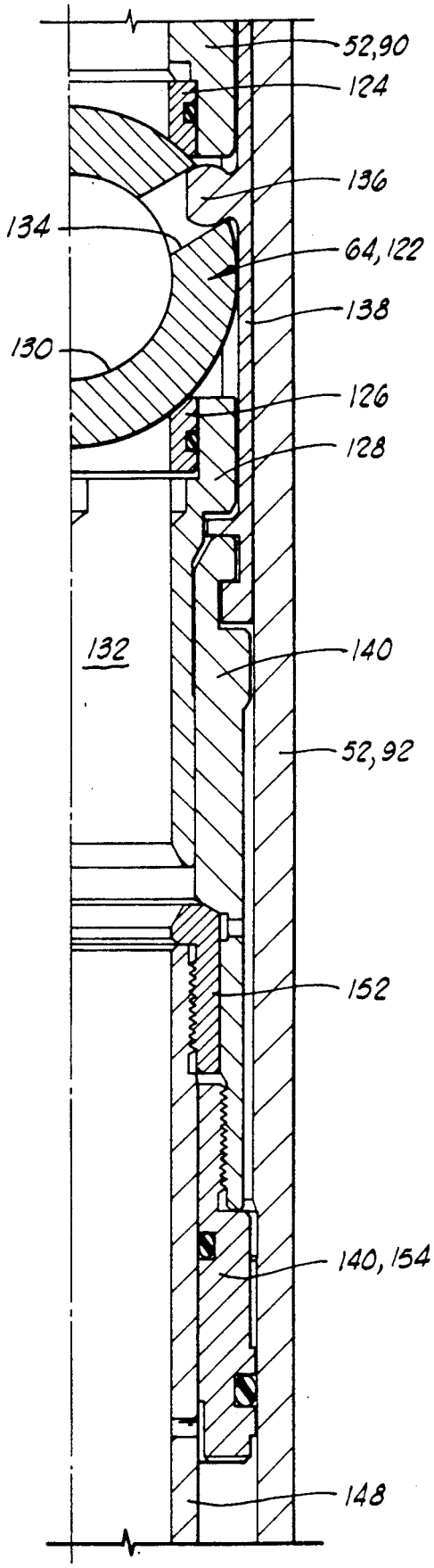

Ball valve element 122 has a bore 130 therethrough which in the closed position shown in FIG. 9B is oriented perpendicular to a longitudinal passageway 132 which extends through the tool 50. The longitudinal passageway 132 communicates with the interior of the tubing string 10 when the tester valve 50 is made up in the tubing string 10.

The ball valve element 122 has a pair of eccentric holes 134 defined therethrough in each of which is received a lug 136. The lug 136 is carried upon a reciprocable arm 138 which is interconnected with an actuating mandrel assembly 140.

Figure 9C:
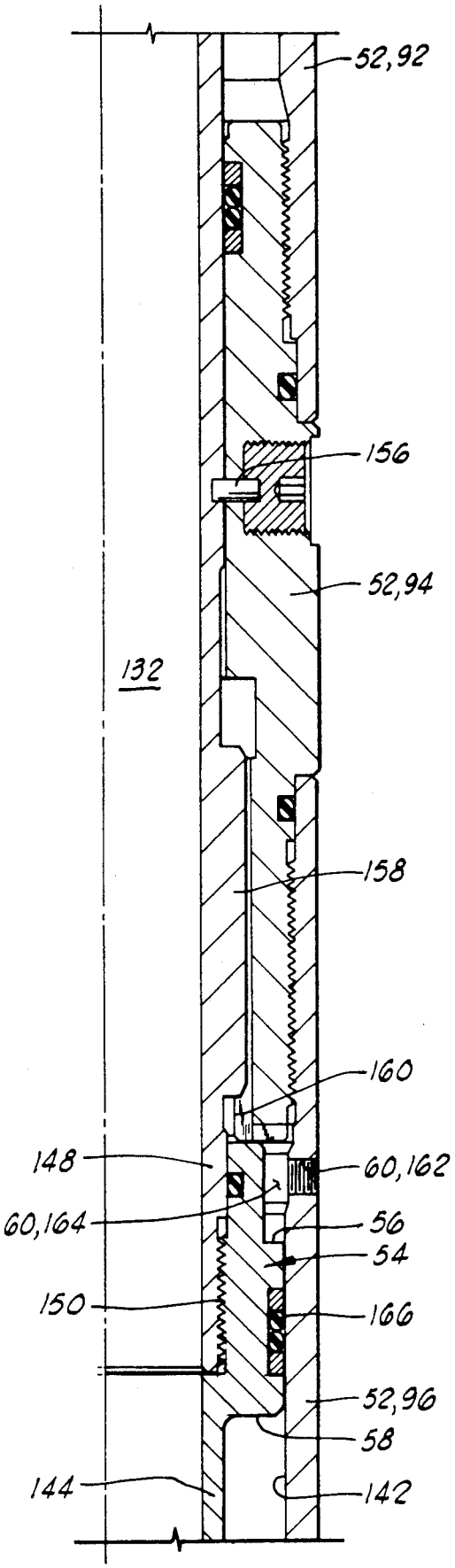
Figure 9D:
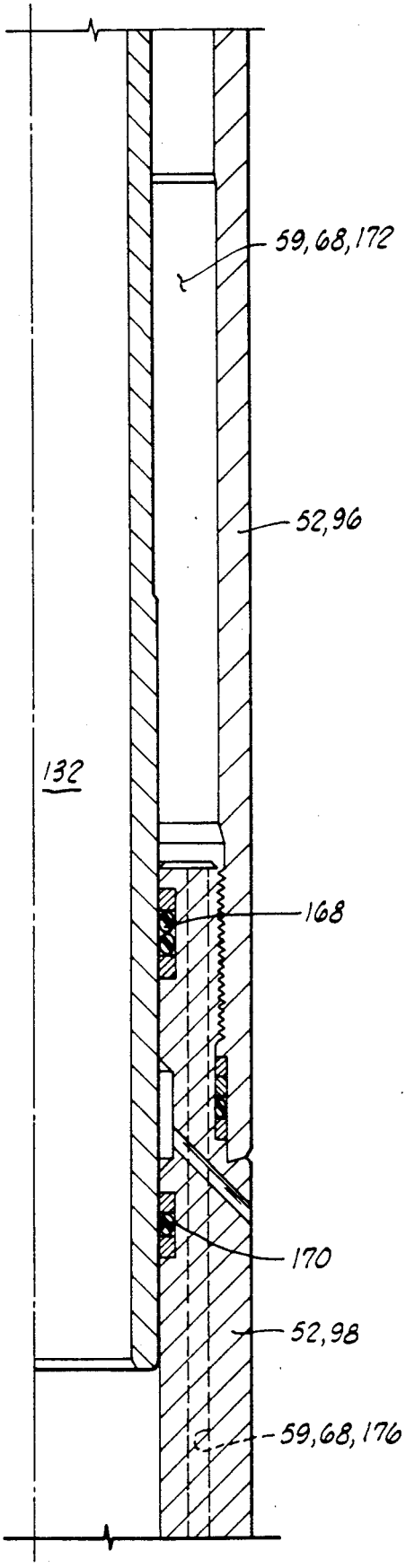

The power piston 54 seen in FIG. 9C is slidably received in a bore 142 of the power case 96. Power piston 54 is defined on the upper end of a lower power mandrel 144.

An upper power mandrel 148 is threadedly connected to lower power mandrel 144 at threaded connection 150 for longitudinal movement therewith.

As seen in FIG. 9B, an end cap 152 is threadedly connected to the upper end of upper power mandrel 148 and overlaps with a lower collar 154 of actuating mandrel assembly 140.

Thus, as the power piston 54 reciprocates back and forth within the power case 96 of tool housing 52, the actuating mandrel assembly 140, arm 138 and lug 136 reciprocate therewith to rotate the ball valve element 122 between the closed position shown in FIG. 9B, and an open position wherein the bore 130 is aligned with longitudinal passageway 132.

The shear pin adapter 94 carries a plurality of shear pins 156 which are received in the upper power mandrel 148 so as to initially retain the upper power mandrel 148 in place as the tool 50 is run into a well so that the power piston 54 will not be prematurely moved from its pinned first position which corresponds to the closed position of the ball valve element 122. After the tool 50 is at its desired location in the well, and the well annulus pressure is increased above hydrostatic pressure to a predetermined operating pressure for the tool 50 with bypass 72 closed, the pins 156 will shear thus allowing the power piston 54 to move downward and to move the ball valve element 122 to an open position. Subsequently, the ball valve 122 can be repeatedly moved between its open and closed positions.

The upper power mandrel 148 includes a plurality of radially outward extending splines 158 which mesh with inward extending splines 160 of power case 96 to prevent rotation of the power mandrels 148 and 144 within housing 52.

The power case 96 includes a plurality of power ports 162 disposed therethrough communicating with an annular cavity 164 defined above power piston 54 and in communication with the first side 56 of power piston 54. Power ports 162 and annular cavity 164 comprise the previously mentioned first pressure conducting passage means 60 defined in the housing 52 for communicating the well annulus 26 with the first side 56 of power piston 54.

Power piston 54 carries a sliding piston seal assembly 166 which seals against the bore 142 of power case 96.

The lower end portion of lower power mandrel 144 is closely and slidably received within first and second O-ring seals 168 and 170 carried by nitrogen fill adapter 98.

Below power piston 54 there is an annular cavity 172 defined between lower power mandrel 144 and power case 96 which defines a first portion of the previously mentioned nitrogen chamber 59.

An annular cavity 174 defined between inner nitrogen chamber mandrel 101 and nitrogen chamber case 100 defines a lower portion of the previously mentioned nitrogen chamber 59. The upper and lower annular cavities 172 and 174 are communicated by a plurality of longitudinal ports 176 which extend through nitrogen fill adapter 98 and which may themselves be considered to be part of the nitrogen chamber 59.

Figure 9E:
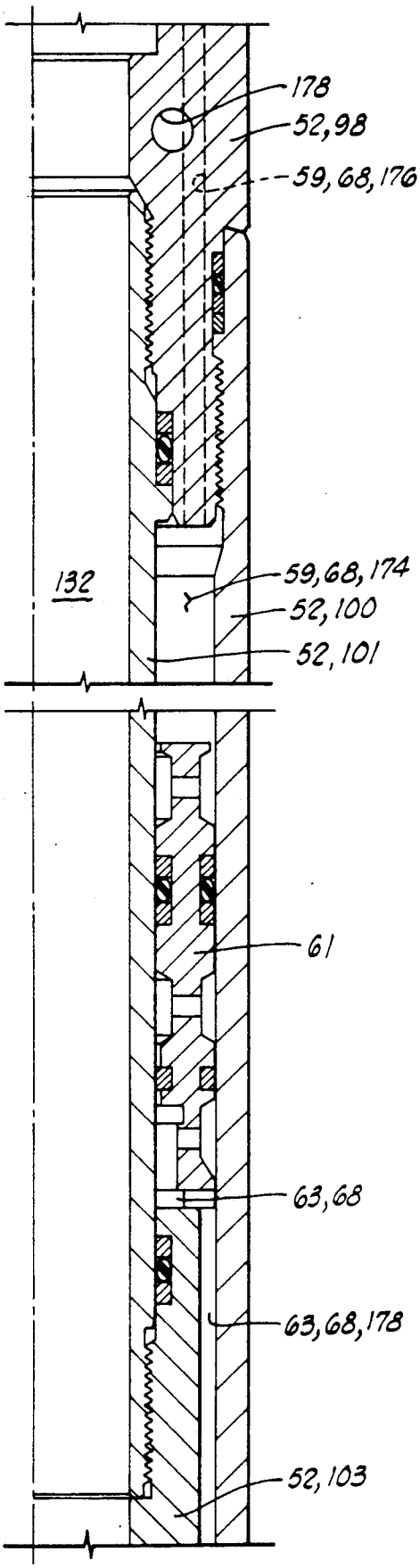
Figure 9F:
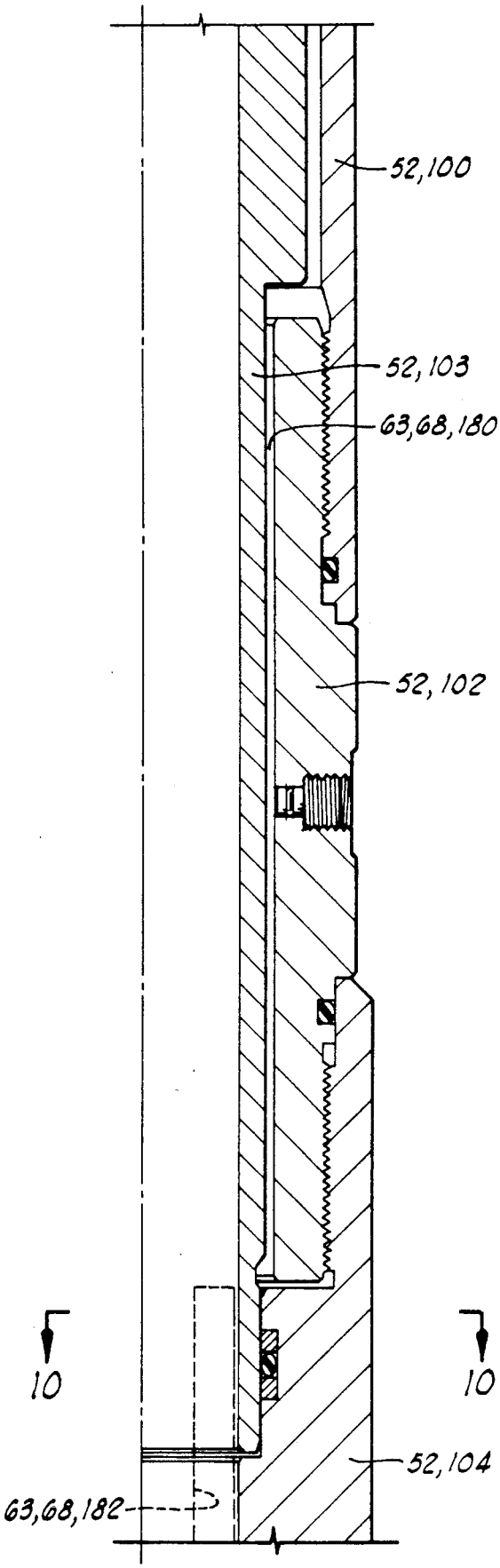

A transverse port 178 seen in FIG. 9E intersects one of the longitudinal ports 176 and a nitrogen fill valve (not shown) contained therein allows the nitrogen chamber 59 to be charged with compressed nitrogen gas when the tool 50 is at the surface.

The floating piston 61 floats within the annular space between nitrogen chamber case 100 and inner nitrogen chamber mandrel 101 and separates the nitrogen chamber 54 from the first oil chamber 63 located therebelow. The first oil chamber 63 is irregular in shape and includes an annular space 178 between inner oil chamber mandrel 103 and nitrogen chamber case 100. It also includes an annular cavity 180 between inner oil chamber mandrel 103 and oil fill adapter 102.

First oil chamber 63 further includes an offset longitudinal bore 182 extending lengthwise through bypass housing section 104 and communicating with the upper end of a metering cartridge 184 which has the metering means 70 therein. The metering cartridge 184 is only partially shown in FIGS. 9I-9J, and is preferably constructed substantially similar to that shown in U.S. Pat. No. 4,444,268 to Barrington, at FIG. 2I thereof, the details of which are incorporated herein by reference.

The metering cartridge 184 has two passageways disposed lengthwise therethrough, one of which serves as a pressurizing passageway and the other of which serves as a depressurizing passageway. Only the pressurizing passageway 186 is illustrated in FIG. 9I. The pressurizing passageway 186, which may also generally be referred to as a metering cartridge passageway 186, has a first restricted orifice 185 of the metering means 70 disposed therein. Located above the restricted orifice 185 is a first back pressure check valve 187 which permits fluid to flow upward through passageway 186 but not downward therethrough. Additionally, the check valve 187 is spring loaded so that it does not allow annulus pressure to completely equalize across the power piston 54. Similarly, in the depressurizing passageway (not shown) of metering cartridge 184 there is another restricted orifice, and a second back pressure check valve which is oriented in the opposite direction to valve 187 so as to allow fluid to flow downwardly therethrough but not upwardly.

The second floating piston 67 is slidably and sealably disposed in the second oil chamber 65 and separates oil contained therein from well fluid which enters through well fluid ports 188 to communicate with the annular mud chamber 69 defined below the second floating piston 67.

The previously mentioned second pressure conducting passage means 68 defined in the housing 52 for communicating the well annulus 26 with the second side 58 of power piston 54 includes the annular cavity 172, longitudinal bores 176, annular cavity 174, annular cavity 178, annular cavity 180, longitudinal bore 182, metering cartridge passage 186, second oil chamber 65, mud chamber 69, and the well fluid ports 188.

Figure 9G:
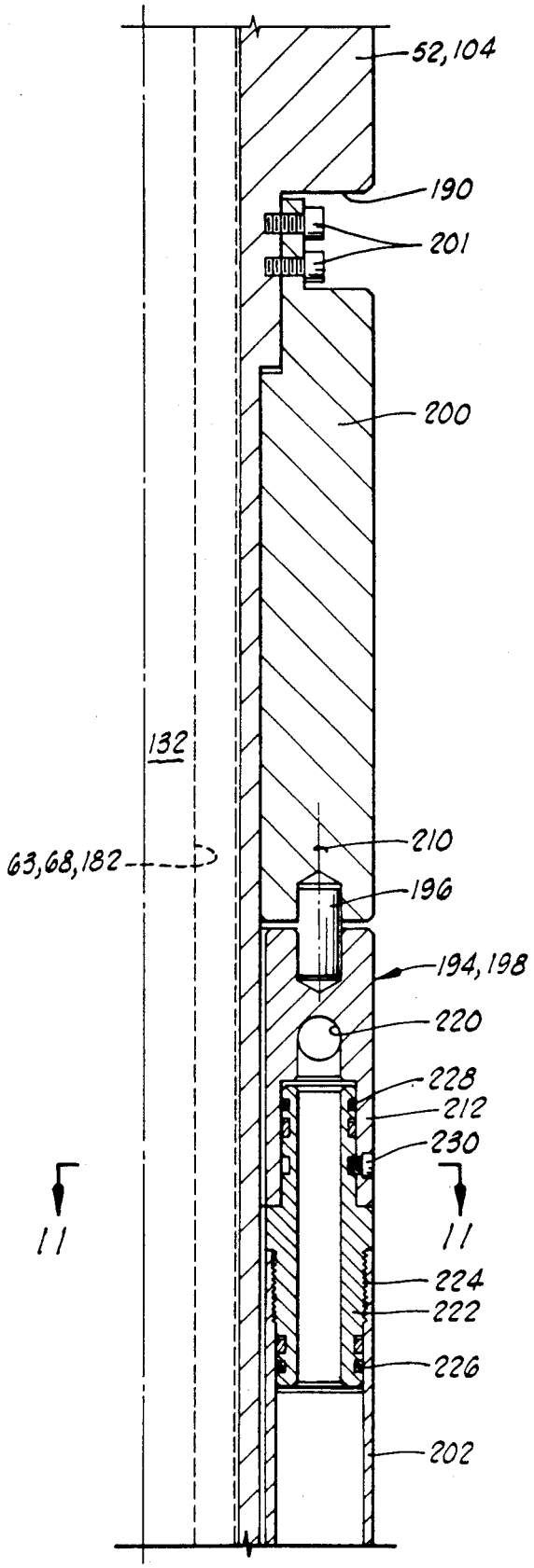
Figure 9H:
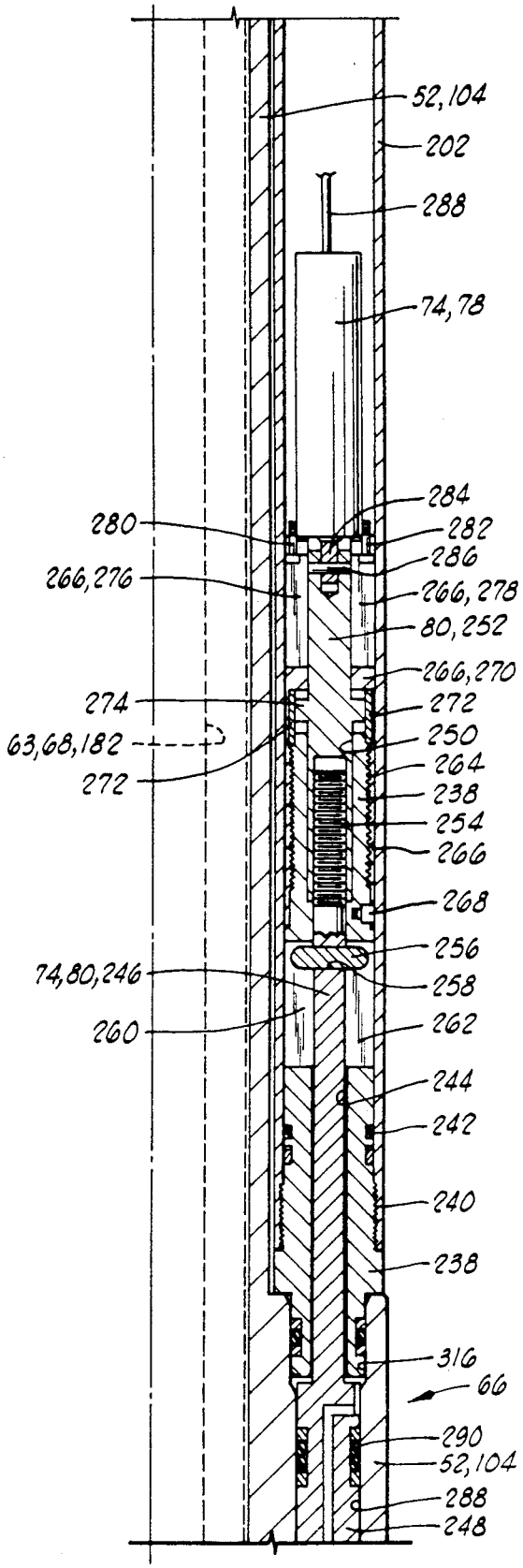
Figure 9I:
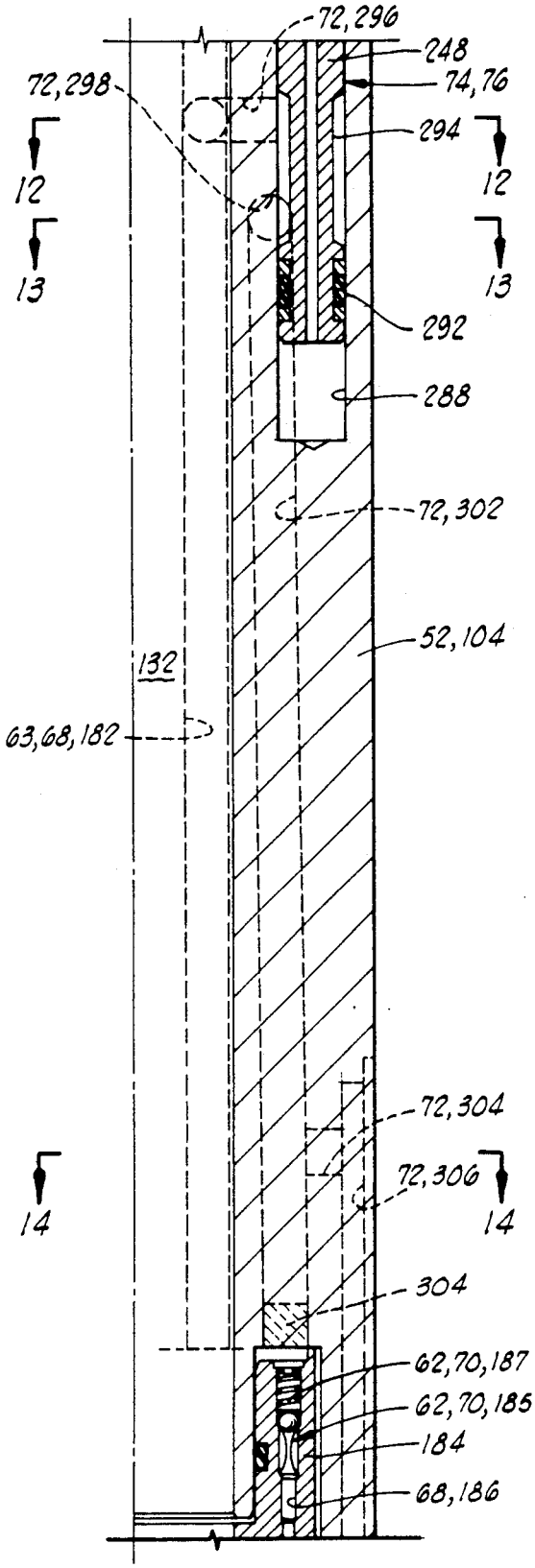

Referring now to FIGS. 9G–9I, the components of the deactivating means 66 are there illustrated.

Figure 11:
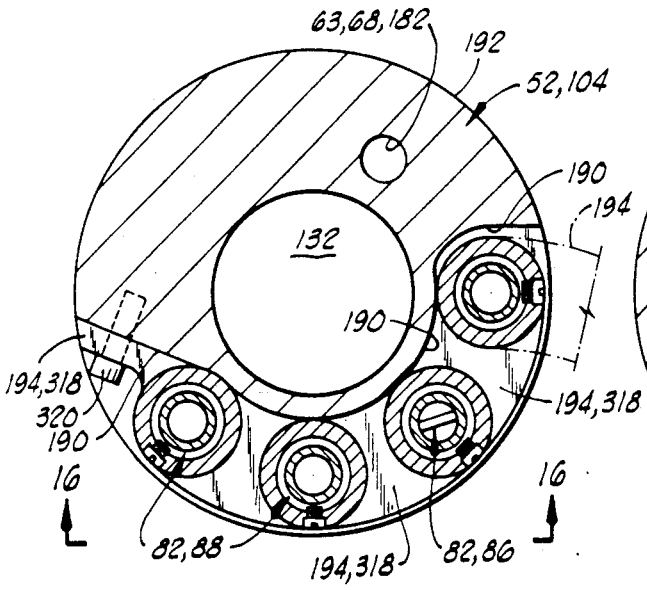
FIG. 11 is a cross-sectional view taken along line 11—11 of FIG. 9G and FIG. 16.

The bypass housing section 104 of tool housing 50 is generally cylindrical in shape, and as seen in the cross-sectional view of FIG. 11, has an arcuate recess 190 defined in an outer cylindrical surface 192 thereof.

A control system framework means 194 for housing the deactivating means 66 is pivotally attached at its upper end to housing 52 by pivot pin 196. The deactivating means 66 may also generally be referred to as a control system 66 which is operably associated with the power piston 54 which may be generally referred to itself as an operating assembly 54.

The control system framework means 194 is pivotally attached to the housing 52 and pivotable between a normal operating position as seen in solid lines in FIG. 11 wherein the framework means 194 is substantially completely received in the arcuate recess 190, and a service position represented in phantom lines in FIG. 11 wherein a substantial portion of the framework means 194 is pivoted out of the recess 190 to provide access to the various components of the deactivating means 66.

For example, as is further described below, when the framework means 194 is pivoted to its service position as shown in phantom lines in FIG. 11, the batteries 88 can be easily removed therefrom and replaced without breaking apart the housing 52 at any of the major threaded connections thereof between segments of the longitudinal housing.

The framework means 194 includes a laterally extending arcuate shaped arm 198 which is pivotally attached to the housing 52.

The pivot pin 196 connects the arm 198 to a mounting means 200. The mounting means 200 itself is a solid arcuate segment fitted within the recess 190 and rigidly attached to the bypass housing segment 104 by a plurality of mounting screws 201. The mounting means 200 is best seen in elevation view in FIG. 16.

Figure 16:
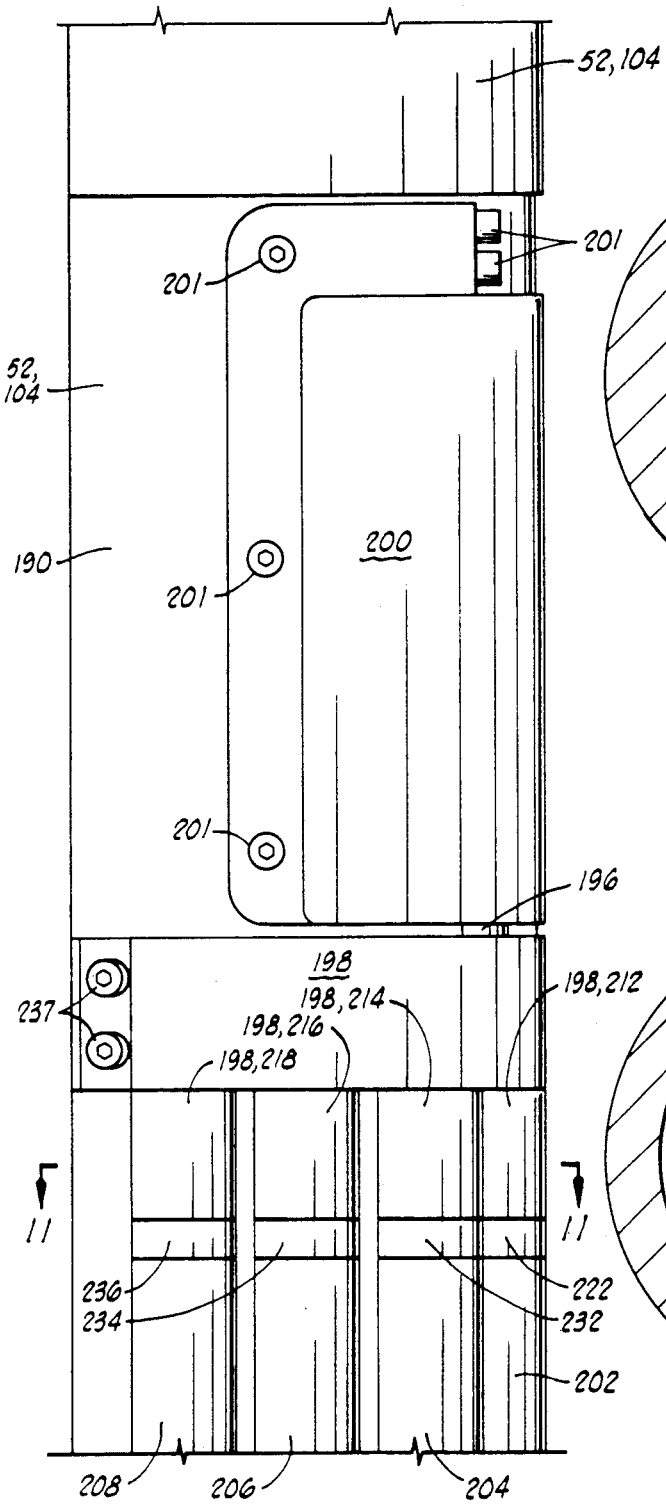
FIG. 16 is a frontal elevation view of a segment of the apparatus of FIGS. 9A–9L corresponding to the segment of FIG. 9G and viewed along line 16—16 as shown in FIG. 11.

The framework means 194 as seen in FIG. 16 further includes four tubes 202, 204, 206 and 208 which are attached to the arm 198 at their upper ends for pivotal movement therewith. The first tube 202 contains the motor 78 of the electrically controlled bypass valve means 74. The second tube 204 contains the microprocessor means 86 and pressure sensor 84. The third and fourth tubes 206 and 208 contain batteries which make up the electrical battery power supply 88.

The first tube 202 which contains the bypass valve means 74 is coaxial with the pivot pin 196 and thus with a pivotal axis 210 (see FIG. 9G) of the control system framework means 194.

In FIG. 9G, the manner of connection of first tube 202 to the arcuate arm 198 is shown in detail and is representative of the manner of connection of the other tubes 204, 206 and 208 to the arcuate arm 198.

The arcuate arm 198 is an intricately shaped member, which is seen in FIGS. 9G, 11 and 16. Arm 198 includes four downwardly extending cylindrical protrusions 212, 214, 216 and 218. As best seen in FIG. 9G, each of the protrusions is hollow and communicates with a passageway 220 defined in the arcuate arm 198. Passageway 220 provides a conduit for electrical wiring which interconnects the various components contained in the tubes 202, 204, 206 and 208.

The first tube 202 has an upper tube head 222 threadedly connected thereto at 224 with an O-ring seal 226 provided therebetween.

The upper end of upper tube head 222 is closely received within the first hollow protrusion 212 of arcuate arm 198 with an O-ring seal 228 provided therebetween, and with a set screw 230 holding the same together.

Similar upper heads 232, 234 and 236 are seen in FIG. 16 connecting the second, third and fourth tubes 204, 206 and 208 to the second, third and fourth protrusions 214, 216 and 218 of arcuate arm 198.

As seen in FIG. 16, when the arcuate arm 198 is in its normal position and received within the recess 190, it is held in place therein by screws 237 which extend into the bypass housing section 104.

As seen in FIG. 9H, the lower end of first tube 202 is connected to a lower tube head 238 at threaded connection 240 with an O-ring seal 242 being provided therebetween.

The lower tube head 238 includes a bore 244 extending longitudinally therethrough within which is received a spool shaft 246. The spool shaft 246 extends downwardly through and out of the bore 244 and has a valve spool 248 defined on the lower portion thereof which is located outside of the tube 202.

The upper end of lower tube head 238 has a counterbore 250 defined therein within which is rotatably received the lower portion of a lead screw shaft 252. The lower portion of lead screw shaft 252 is hollow and has a female thread defined therein which is threadably engaged with the upper end of spool shaft 246 to define a lead screw 254 therebetween.

A pin 256 is received through a transverse bore 258 in spool shaft 246. The ends of pin 256 are received in two diametrically opposed slots 260 and 262 defined in lower tube head 238 so as to prevent the spool shaft 246 from rotating relative to lower tube head 238. Thus, upon rotation of the lead screw shaft 252 relative to the spool shaft 246 the lead screw 254 will cause the spool shaft 246 and valve spool 248 to move longitudinally relative to the tube 202 and housing 52.

The upper portion of lower tube head 238 is externally threaded at 264 and is thereby threadedly connected to a bearing housing 266. A set screw 268 locks bearing housing 266 to the lower tube head 238. The bearing housing 266 includes a radially inward extending flange 270 which holds an annular bearing 272 sandwiched between the flange 270 and the upper end of lower tube head 238.

The lead screw shaft 252 includes an enlarged diameter shoulder 274 which is closely and rotatably received within bearing 272.

The bearing housing 266 further includes first and second upwardly extending support brackets 276 and 278 on diametrically opposite sides of lead screw shaft 252. The motor 78 is mounted on the upper portions of support brackets 276 and 278 with mounting screws 280 and 282.

A motor shaft 284 extends downward from electric motor 78 and is connected to lead screw shaft 252 by a coupling pin 286. Electric wiring 288 extends from motor 78 up through the tube 202 and through the conduit 220 in arcuate arm 198 to connect the motor 74 to the microprocessor means 86 and electrical battery power supply 88.

As mentioned, the upper ends of second, third and fourth tubes 204, 206 and 208 are attached to arcuate arm 198 in a similar manner to that just described for first tube 202.

The second tube 204 which contains the microprocessor means 86 and pressure transducer 84 has the pressure transducer 84 located in its lower end portion (not shown) so that the pressure transducer communicates through an opening (not shown) in the lower end of second tube 204 with the well annulus 26.

The lower ends (not shown) of third and fourth tubes 206 and 208 are closed with a sealed plug so as to prevent well fluids from entering the same and damaging the batteries contained therein.

As seen in FIGS. 9H and 9I, the valve spool 248 which extends out of the end of the first tube 202 is closely and slidably received within a valve bore 288 defined in the bypass housing section 104.

The valve spool 248 has upper and lower seal assemblies 290 and 292 which sealingly engage valve bore 288. A reduced diameter spool portion 294 is located between upper and lower seal assemblies 290 and 292.

The valve spool 248 and valve bore 288 comprise the valve element 76 of electric motor control valve means 74 schematically illustrated in FIG. 2. The valve spool 248 is disposed in the bypass passage 72 so as to open and close the same.

Figure 9J:
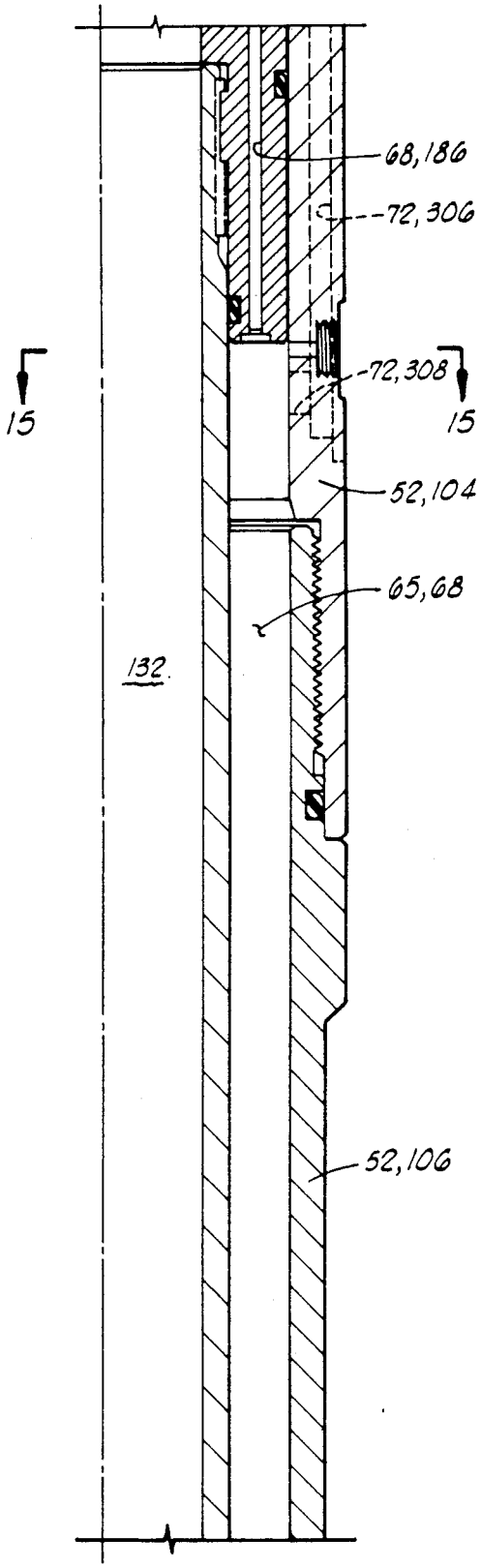
Figure 9K:
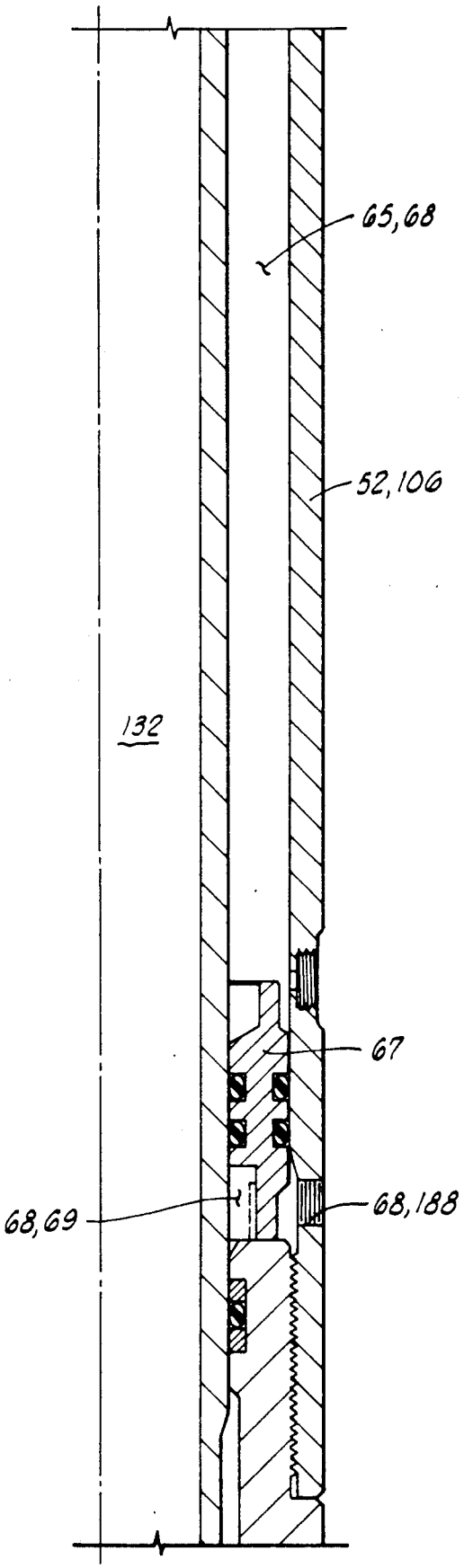
Figure 9L:
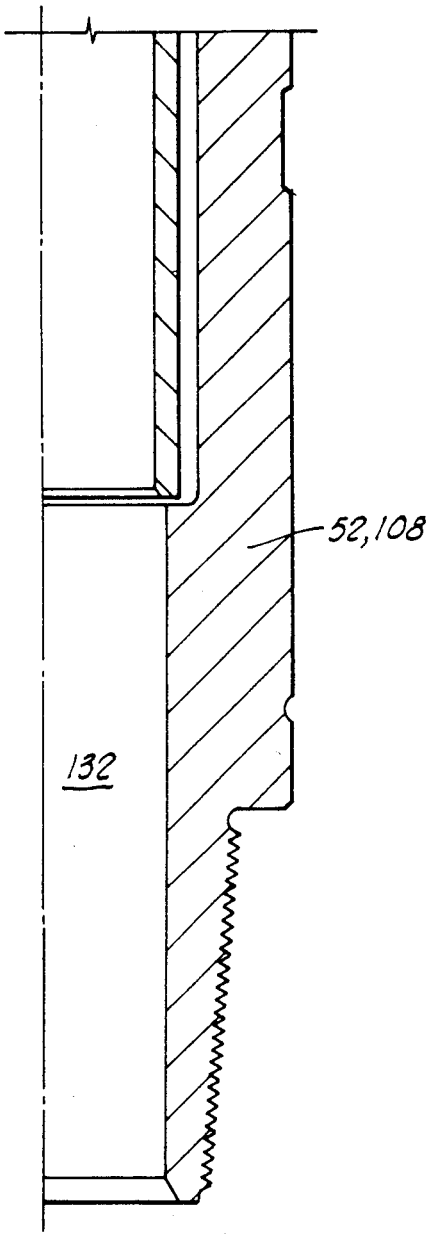
Figure 10:
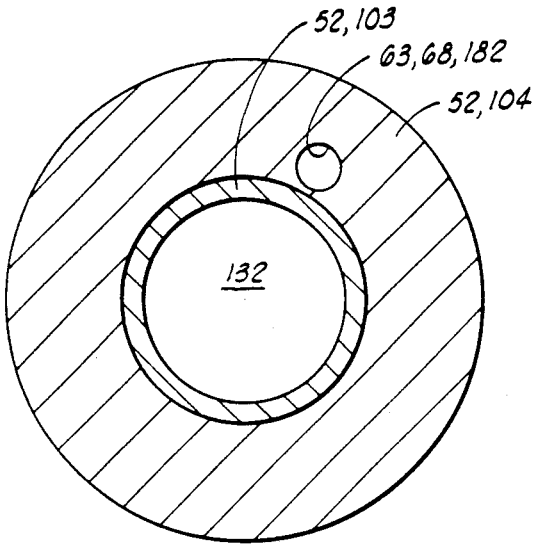
FIG. 10 is a cross-sectional view taken along line 10—10 of FIG. 9F.
Figure 12:
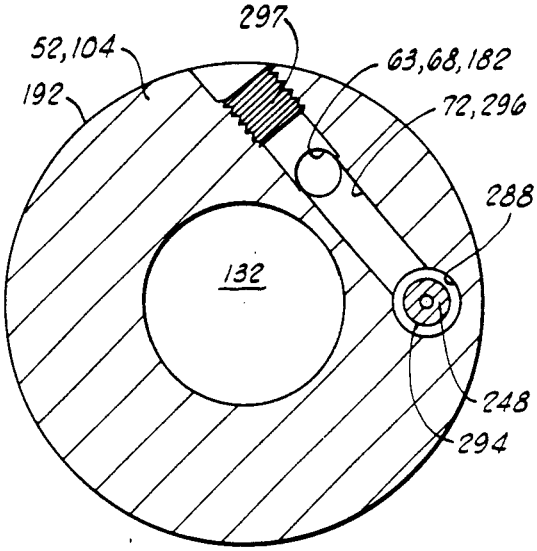
FIG. 12 is a cross-sectional view taken along line 12—12 of FIG. 9I.

The construction of the bypass passage means 72 is apparent in FIGS. 9I–9J. As seen near the upper end of FIG. 9I and in FIG. 12, the bypass passage means 72 begins with a first lateral bore 296 communicating longitudinal bore 182 with the valve bore 288. The lateral bore 296 is formed by drilling into the bypass housing section 104 through its outer surface 192, with the outer portion of the bore then being plugged by plug 297.

Figure 13:
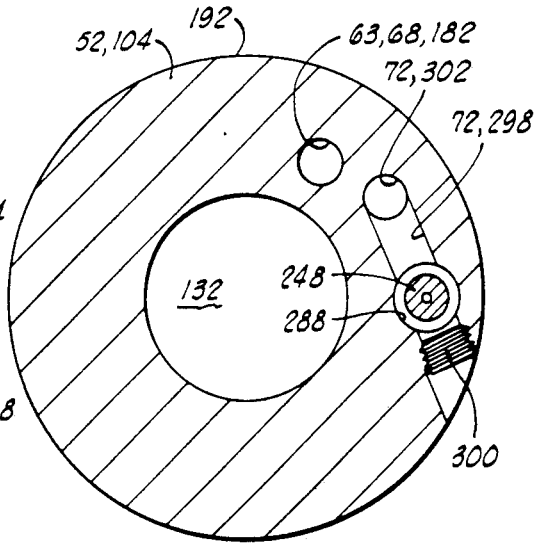
FIG. 13 is a cross-sectional view taken along line 13—13 of FIG. 9I.

As best seen in FIG. 13 and FIG. 9I, a short distance below the first lateral bore 296 is a second lateral bore 298 which also communicates with the valve bore 288. The portion of valve bore 288 between first and second lateral bores 296 and 298 may be considered to be part of the bypass passage means 72.

The second lateral bore 298 is constructed in a similar fashion to first bore 296 by drilling through from the exterior surface 192 and plugging with a plug 300.

Continuing downward from the second lateral bore 298, the bypass passage means 72 includes a longitudinal bore 302 defined in bypass housing section 104 and having its lower end plugged by plug 304.

Figure 14:
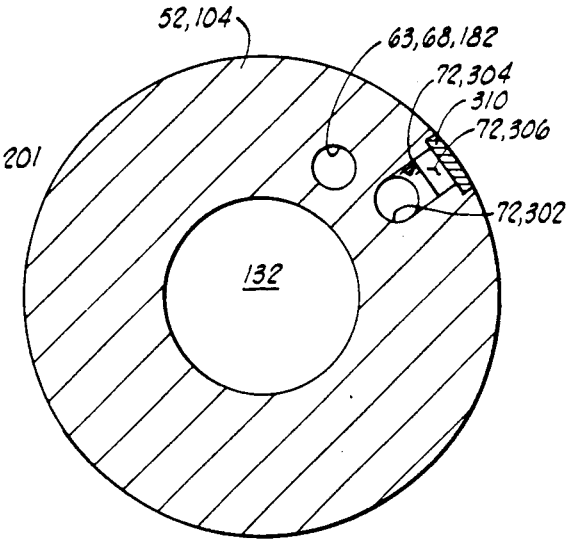
FIG. 14 is a cross-sectional view taken along line 14—14 of FIG. 9I.

As seen in FIG. 14 and near the lower end of FIG. 9I, the bypass passage means 72 then includes a short radial bore 304 which communicates with a rectangular cross section longitudinal passageway 306 extending lengthwise and spanning the length of metering cartridge 184. Finally, another short radial bore 308 communicates passageway 306 with the second oil chamber 65 below the metering cartridge 184.

Figure 15:
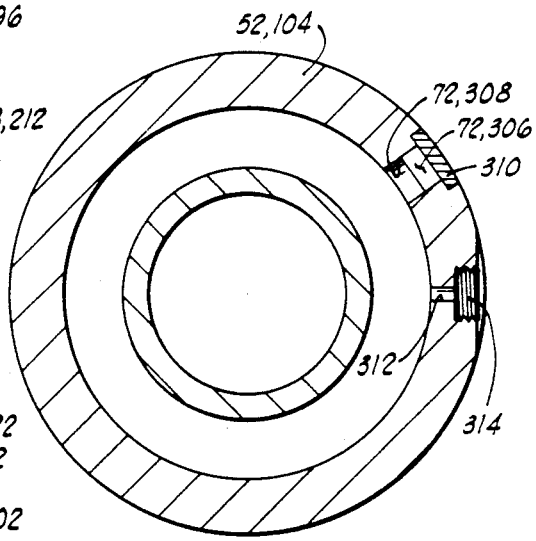
FIG. 15 is a cross-sectional view taken along line 15—15 of FIG. 9J.

As is best seen in FIGS. 14 and 15, the rectangular cross-sectional longitudinal passageway 306 is formed by milling out a lengthwise strip of the exterior surface of bypass housing section 104 and then welding a metal strip 310 thereacross to close a portion of the same leaving the passageway 306 defined within the wall of bypass housing section 104.

As is also seen in FIG. 15, there is an oil fill port 312 which is closed by plug 314. Fill port 312 allows oil chambers 63 and 65 to be filled.

The spool 248 is shown in FIGS. 9H–9I in the open position with reduced diameter portion 294 allowing free communication between lateral bores 296 and 298. The motor 78 can rotate lead screw shaft 252 to move spool 248 downward within bore 288 until reduced diameter portion 294 is out of registry with lateral bore 296, thus defining the closed position of spool 248. It is noted that when spool 248 is in its closed position, there is not a closed seal between lateral ports 296 and 298, but the close fit between spool 248 and bore 288 is sufficient to prevent any significant oil flow therethrough.

It is noted that the lower tube head 238 seen in FIG. 9H is received within a counterbore 316 of the valve bore 288 of bypass housing section 104. Lower tube head 238 serves as the bottom pivot pin for the control system framework means 194. Thus the arcuate arm 198 with the four attached tubes 202, 204, 206 and 208 pivot relative to housing 52 about the pivotal axis 210 defined by pivot pin 196 and by the lower tube head 238.

As is seen in FIG. 11, the framework means 194 includes an arcuate bracket 318 interconnecting the lower ends (not shown) of tubes 202, 204, 206 and 208. Screws 320 hold the bracket 318 in place when the framework means 194 is in its normal position received within the arcuate recess 190.

As previously mentioned, the pivotal mounting of control system framework means 194 upon the housing 52 allows it to be pivoted to its open service position as shown in phantom lines in FIG. 11 so that the batteries can be removed and replaced in tubes 206 and 208 and so that the electronic components in tube 204 can be removed and serviced.

Additionally, the mounting means 200 seen in FIG. 9G can be completely removed from the bypass housing section 104 thus allowing the entire control system framework means 194 to slide upward until valve spool 248 is completely removed from valve bore 288, thus permitting the framework means 194 to be completely separated from the tool housing 52 without breaking apart the tool housing 52 at any threaded joint thereof.

Manner of Operation of the Apparatus of FIGS. 2 and 9

The downhole tool 50 is lowered into a well on a test string until it reaches a depth at which it is desired to test the well. A packer (not shown) in place in the test string is set against the well bore to seal the well annulus below the tester valve 50. The tool 50 may initially be run into the well with the spool valve 248 in its closed position closing the bypass passage means 72.

After the packer has been set, the tester valve 64 can be opened by applying a predetermined pressure to the well annulus thus shearing the shear pin 156 and allowing the power piston 54 to move downward within housing 52 thus moving the spherical ball valve element 122 to an open position.

After a sufficient time has passed, the well annulus pressure will nearly equalize through the metering cartridge 184. The pressure in the nitrogen chamber 59 will stabilize to a value slightly less than well annulus pressure because of the presence of the back pressure check valve 187. This maintains a slight pressure differential across the power piston 54 and helps to maintain it in its open position. Then well annulus pressure may be decreased rapidly to hydrostatic pressure thus reclosing the spherical ball valve member 122. Again, as the well annulus pressure equalizes across the metering cartridge 184, the pressure retained in nitrogen chamber 59 will be at a pressure slightly above the hydrostatic well annulus pressure because of the effect of the back pressure check valve (not shown) in the depressurizing passage (not shown) of metering cartridge 184. This small pressure differential helps to keep the power piston 54 in its closed position.

The power piston 54 of tool 50 is powered entirely by hydraulic energy provided to fluid in the tool 50 which fluid is pressurized by increasing well annulus pressure above hydrostatic pressure. Further, the tool 50 is endlessly cyclable between its first and second positions. That is, there is no limit to the number of times that the valve element 64 can be opened by rapidly increasing well annulus pressure and subsequently reclosed by rapidly decreasing well annulus pressure.

At any time when the tool 50 is in the well, if it is desired to deactivate the tool so that the power piston 54 will no longer be moved by rapid changes in well annulus pressure, the same can be accomplished with the deactivating means 66. This might be desirable when for example other annulus pressure responsive tools need to be manipulated without concern for undesired premature operation of the tool 50.

This is accomplished by transmitting a command signal down the well annulus 26. The command signal will be a pressure pulse of predetermined character which will be recognized by the deactivating means 66.

This command signal is detected at the tool 50 by the pressure sensor 84 which creates an electrical signal detected and recognized by microprocessor means 86 which in turn controls the operation of electric motor 78 to cause the valve spool 248 to move to its open position as illustrated in FIGS. 9H–9I thus opening the bypass passage 72 and bypassing well annulus fluid around the metering cartridge 184 and particularly around the restricted orifices such as 185 thereof.

This temporarily deactivates the power piston 54 of tool 50 in response to detection of this command signal so that the power piston 54 is no longer responsive to changes in well annulus pressure.

This bypassing of well annulus fluid around the metering cartridge 184 balances well annulus pressure across the power piston 54.

Subsequently, if it is desired to again utilize the tool 50, a second command signal is transmitted down the well annulus, and is detected by the pressure sensor 84 and microprocessor means 86 which will cause the motor 74 to move the valve spool 248 down to its closed position thus closing the bypass passage means 72 and thereby reactivating the power piston 54 so that the power piston 54 will again be responsive to changes in well annulus pressure.

Then the well annulus pressure can be changed to again move the power piston 54 and open and close the spherical valve member 122 as desired.

Another important feature of the tool 50 is that the ball valve 122 can be opened in the manner just described, and then the tool 50 can be deactivated before releasing well annulus pressure. This allows the tool 50 to be opened with annulus pressure and then left open after annulus pressure is released.

There are a couple of ways to reclose the valve 122 of tool 50 after it is left open in the manner just described. First, the tool 50 can be signaled to activate the metering means 70 and keep it activated until annulus pressure was increased and then decreased. The tool would stay open as annulus pressure was increased, but then would close when pressure was again released. Alternatively, the tool 50 can be signaled to enable the metering means 70 after annulus pressure has been increased. This traps the increased annulus pressure in the nitrogen chamber. Then upon decreasing annulus pressure the valve 122 would be closed.

Also, it is possible to have several tools equipped with a deactivating means like deactivating means 66, all of those tools being in the same tool string and being constructed to respond to different signals. For example, a tool string could include a tester valve and a circulating valve, each responding to different pressure signals and being operated independently of each other.

Also, as previously mentioned, the deactivating means 66 can be constructed to respond to signals other than annulus pressure signals. For example, it can be responsive to acoustic signals or could automatically be disabled in response to clock settings.

Other Embodiments of the Invention

The present invention is applicable to many different types of downhole tools, and the tester valve illustrated in FIGS. 9A–9L is for purposes of illustration only. The invention can be applied to any number of other tools such as circulation valves, samplers and the like.

Additionally, the concept of deactivating an annulus pressure responsive tool is applicable to many other annulus pressure responsive operating systems other than that one particular prior art system schematically illustrated in FIG. 1.

Figure 4:
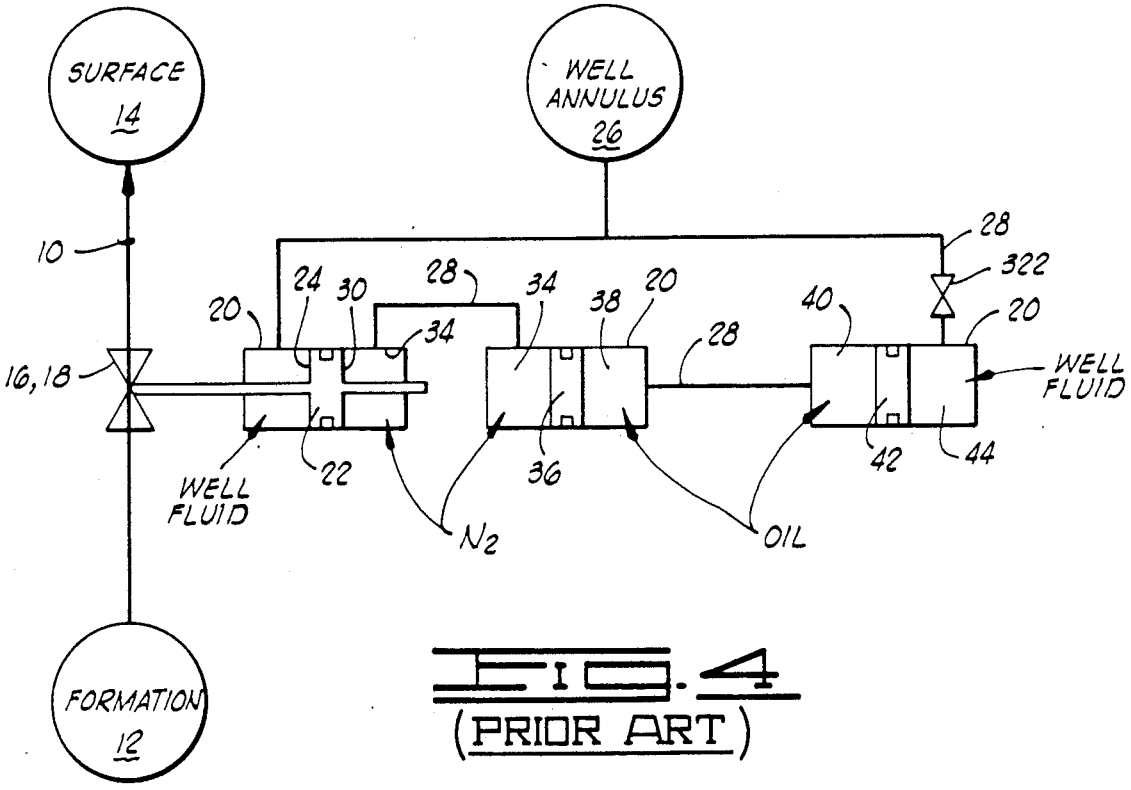
FIG. 4 (PRIOR ART)
FIG. 4 is a schematic illustration of a second type of typical prior art annulus pressure responsive downhole tool.
Figure 5:
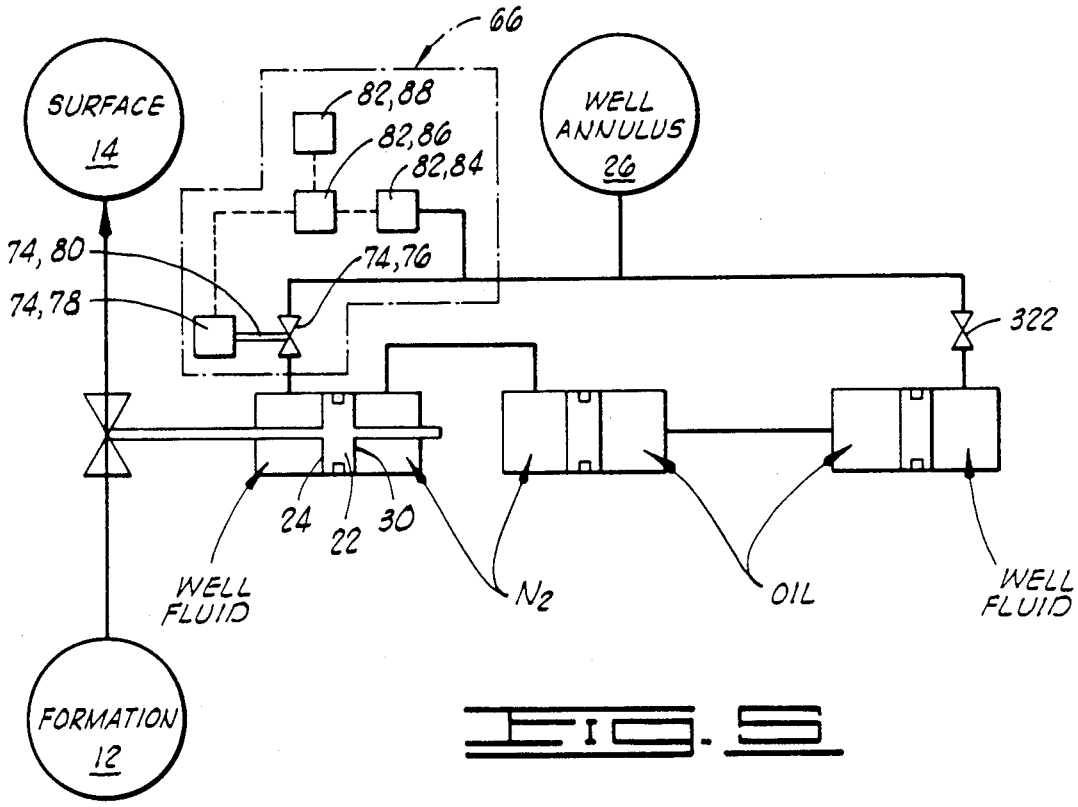
FIG. 5 is a schematic illustration of a downhole tool similar to that of FIG. 4 which has been modified in accordance with the present invention to provide a means for temporarily deactivating the tool.
Figure 6:
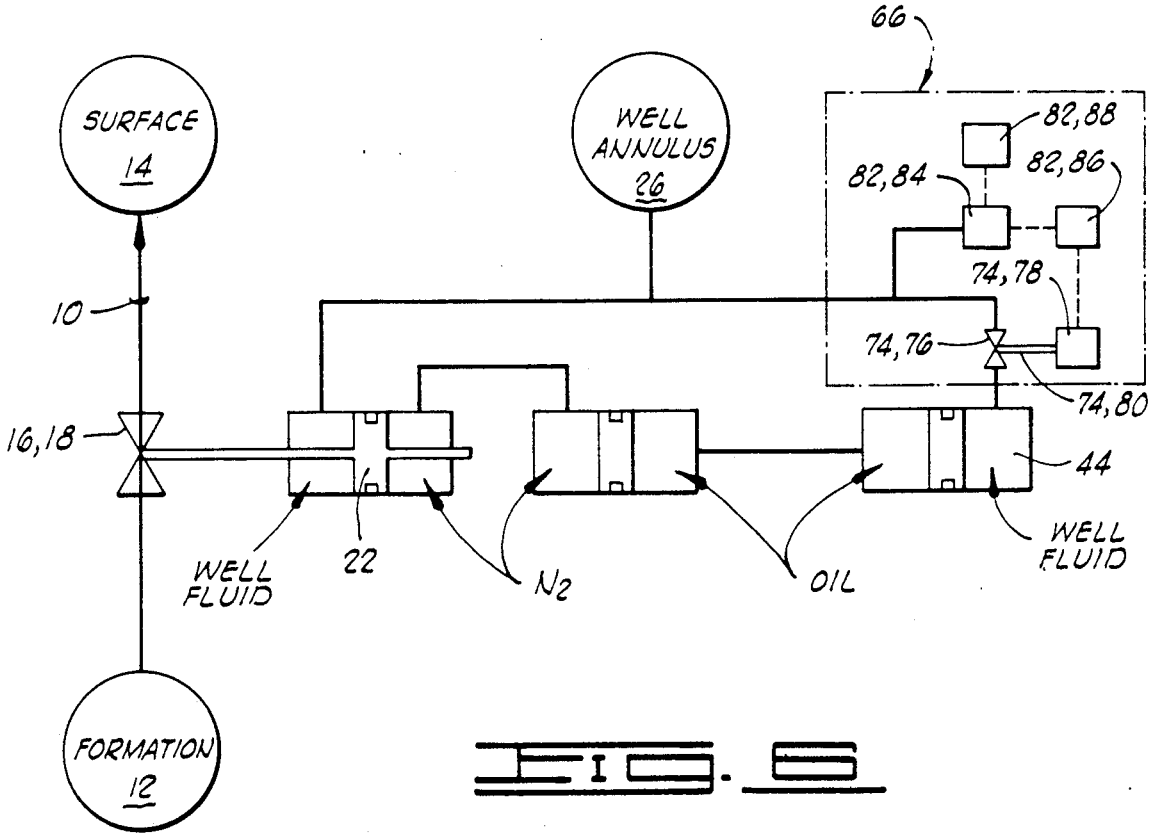
FIG. 6 is a schematic illustration, again of a tool similar to the prior art tool of FIG. 4, which has been modified in another manner in accordance with the present invention to provide a means for temporarily deactivating the tool.
Figure 7:
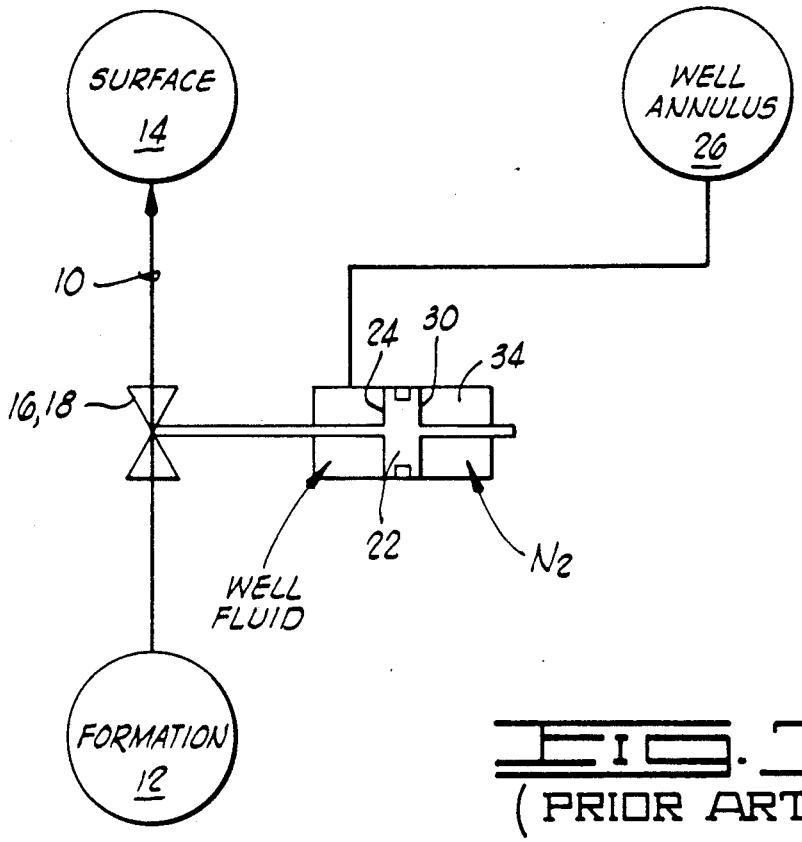
FIG. 7 (PRIOR ART)
FIG. 7 is a schematic illustration of yet another typical prior art annulus pressure responsive tool.
Figure 8:
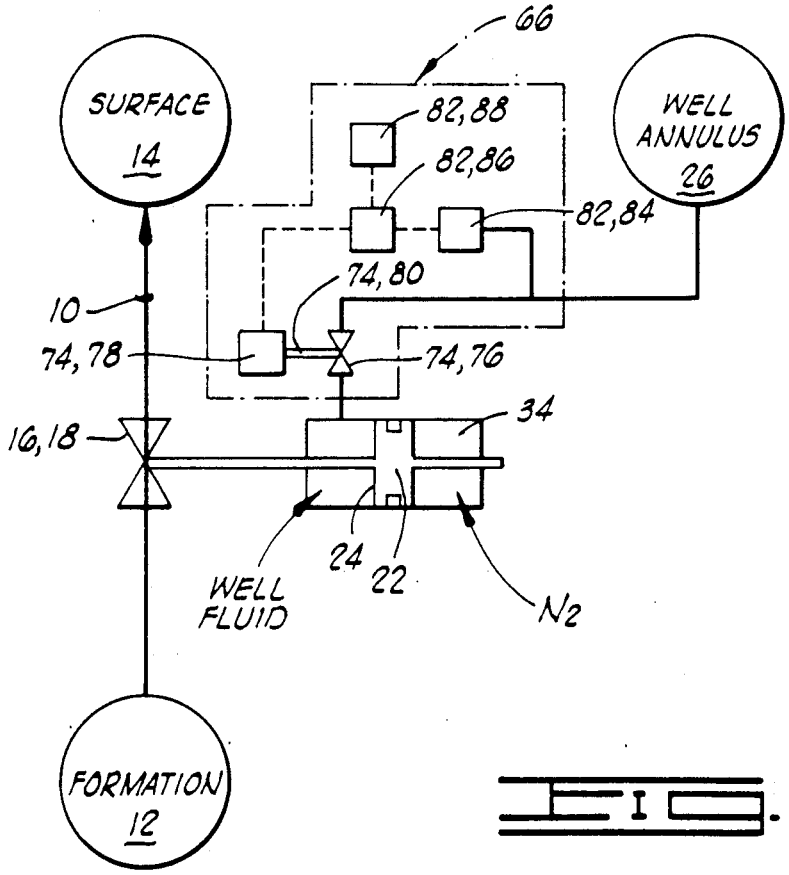
FIG. 8 is a schematic illustration of a tool similar to the prior art tool of FIG. 7 which has been modified in accordance with the present invention to provide a means for temporarily deactivating the tool.

For example, FIGS. 4 and 7 schematically illustrate two other types of annulus pressure responsive operating systems known to the prior art. FIGS. 5 and 6 illustrate applications of the present invention to systems of the type shown in FIG. 4, and FIG. 8 schematically illustrates the application of the present invention to systems of the type shown in FIG. 7.

The prior system illustrated in FIG. 4 is somewhat similar to that previously described with regard to FIG. 1, except that there is no metering means 32 or other time delay means placed in the second fluid conducting passageway 28. Instead, an isolation valve means 322 is provided in the tool between the well annulus 26 and the mud chamber 44. The tool is lowered into the well with the isolation valve 322 in an open position so that the pressure in nitrogen chamber 34 will be equivalent to hydrostatic pressure in the well annulus 26. Then, when the well tool is at its final depth, the isolation valve 322 is closed so as to trap the nitrogen at substantially hydrostatic pressure at that depth within the well annulus. Subsequently, well annulus pressure is increased to create a pressure differential relative to the trapped hydrostatic pressure in nitrogen chamber 34. A typical example of such a prior art system is seen in U.S. Pat. No. 3,856,085 to Holden et al.

FIG. 5 illustrates one method by which a tool like that shown in FIG. 4 can be deactivated with the deactivating means 66. The electric motor controlled valve means 74 is placed between the well annulus 26 and the first side 24 of power piston 22 so that the power piston 22 can be deactivated by isolating the power piston 22 from the well annulus 26 when the valve element 76 is closed. With the valve element 76 closed, changes in well annulus pressure are not sensed by power piston 22 and thus the tool does not operate. Subsequently, the tool can be reactivated by opening the valve element 76.

In the embodiment of FIG. 6, a tool having an operating mechanism generally like that of the prior art tool of FIG. 4 has been modified in a different manner by replacing the isolation valve 322 with the electric motor controlled valve 74. The valve element 76 can be placed in an open position when it is desired to deactivate the tool. When the valve element 76 is in an open position, well annulus pressure is balanced across the power piston 22 so it will not move in response to changes in well annulus pressure. The tool can again be reactivated by closing the valve element 76 to trap hydrostatic pressure in chamber 44 which will then serve as a reference pressure against which increased well annulus pressure can operate to move the power piston 22.

FIG. 7 illustrates another typical operating mechanism for prior art annulus pressure responsive tools wherein the nitrogen chamber 34 is a simple sealed chamber which is precharged prior to the time the tool is placed in the well. The compressed gas in nitrogen chamber 34 serves as a compressible fluid spring against which well annulus pressure operates to cause the power piston 22 to move back and forth to operate the tester valve 18 or other operating mechanism of the tool. An example of such a tool is seen in U.S. Pat. No. 3,664,415 to Wray et al.

As illustrated in FIG. 8, the present invention can be applied to a tool utilizing an operating mechanism similar to that shown in FIG. 7 by placing the electric motor controlled valve 74 between the first side 24 of power piston 22 and the well annulus 26. When the valve element 76 is closed, the power piston 22 is isolated from the well annulus 26 thus preventing operation of the tool. The tool can be reactivated by opening the valve element 76 so that changes in well annulus pressure 26 as contrasted to the reference pressure in chamber 34 can cause the power piston 22 to move back and forth to operate the valve member 18.

Thus it is seen that the apparatus and methods of the present invention readily achieve the ends and advantages mentioned as well as those inherent therein. While certain preferred embodiments of the invention have been illustrated and described for purposes of the present disclosure, numerous changes may be made by those skilled in the art which changes are encompassed within the scope and spirit of the present invention as defined by the appended claims.

What is claimed is:

1. A downhole tool apparatus responsive to changes in pressure in a well annulus comprising:

a tool housing;

a power piston slidably disposed in said tool housing, said piston having a first side and a second side;

a first pressure conducting passage means, defined in said tool housing, for communicating said well annulus with said first side of said power piston;

reference pressure means, disposed in said tool housing, for providing a reference pressure communicated with said second side of said power piston, so that a change in well annulus pressure creates a pressure differential across said power piston to move said power piston between a first position and a second position relative to said tool housing; and selectively operable deactivating means for temporarily deactivating said power piston so that said power piston is no longer responsive to changes in well annulus pressure.

2. The apparatus of claim 1, wherein:

said selectively operable deactivating means is a selectively operable bypass means for bypassing changes in well annulus pressure around said reference pressure means.

3. The apparatus of claim 2, wherein:

said bypass means has an open position wherein changes in well annulus pressure are substantially immediately communicated with said second side of said power piston and said power piston is not moved by changes in well annulus pressure, and a closed position wherein said second side of said power piston is in operable communication with said reference pressure means.

4. The apparatus of claim 2, wherein said bypass means comprises:

a bypass passage means, defined in said tool housing, for communicating said well annulus with said second side of said power piston;

bypass valve means, disposed in said bypass passage means, for selectively opening and closing said bypass passage means as said bypass valve means is moved between an open position and a closed position; and control means for moving said bypass valve means between its said open and closed positions.

5. The apparatus of claim 4, wherein:

said control means is further characterized as being responsive to changes in well annulus pressure.

6. The apparatus of claim 1, wherein:

said deactivating means is further characterized as a means for balancing well annulus pressure across said power piston to deactivate said power piston.

7. The apparatus of claim 1, wherein:

said deactivating means is further characterized as a means for isolating well annulus pressure from said power piston to deactivate said power piston.

8. A downhole tool apparatus, comprising:

an operating means for operating said apparatus in response to changes in well annulus pressure; and deactivation means for repeatedly selectively deactivating said operating means so that said operating means is no longer responsive to changes in well annulus pressure and for subsequently reactivating said operating means so that said operating means is again responsive to changes in well annulus pressure.

9. The apparatus of claim 8, wherein:

said deactivation means is movable between deactivated and reactivated positions thereof in response to predetermined changes in well annulus pressure.

10. The apparatus of claim 8, wherein:

said operating means is powered by energy provided to fluid in said apparatus pressurized by increasing well annulus pressure above hydrostatic pressure.

11. The apparatus of claim 10, wherein:

said operating means is endlessly cyclable between first and second positions thereof.

12. The apparatus of claim 10, wherein:

said operating means is powered entirely by energy provided to fluid in said apparatus pressurized by increasing well annulus pressure above hydrostatic pressure.

13. The apparatus of claim 8, wherein:

said operating means is endlessly cyclable between first and second positions thereof.

14. The apparatus of claim 8, wherein:

said operating means includes a power piston communicated with the well annulus; and said deactivation means is further characterized as a means for causing changes in well annulus pressure to be balanced across said power piston of said operating means to thereby deactivate said operating means.

15. The apparatus of claim 8, wherein:

said operating means includes a power piston communicated with said well annulus; and said deactivation means is further characterized as a means for isolating said well annulus from said power piston to deactivate said power piston.

16. A downhole tool apparatus, comprising:

a cylindrical tool housing having a recess defined in an outer cylindrical surface thereof;

an operating assembly disposed in said housing;

a control system operably associated with said operating assembly; and a control system framework means for housing said control system, said framework means being pivotally attached to said housing and pivotal between a normal operating position wherein said framework means is substantially completely received in said recess of said housing and a service position wherein a substantial portion of said framework means is pivoted out of said recess to provide access to said control system.

17. The apparatus of claim 16, wherein:

said control system includes an electrical battery power supply; and said framework means is further characterized as a means for permitting replacement of said electrical battery power supply without breaking apart said tool housing.

18. The apparatus of claim 16, wherein said framework means comprises:

a laterally extending arm pivotally attached to said housing; and a plurality of tubes extending longitudinally generally parallel to a longitudinal axis of said housing, said tubes being attached to said arm for pivotal movement therewith.

19. The apparatus of claim 18, wherein:

one of said tubes is coaxial with a pivotal axis of said framework means.

20. The apparatus of claim 19, wherein:

said control system includes a drive motor contained in said one coaxial tube and a valve spool attached to said drive motor and extending out of an end of said one coaxial tube, said valve spool being operably received in a valve bore defined in said tool housing.

21. The apparatus of claim 18, wherein:

said plurality of tubes includes at least a first tube, a second tube and a third tube;

said control system includes:

an electrically powered control mechanism disposed in said first tube;

an electronic sensing means and a microprocessor means disposed in said second tube for detecting a command signal and operating said control mechanism in response thereto; and an electrical power supply in said third tube; and wherein said arm of said framework means has defined therein wiring conduits communicating said first, second and third tubes.

22. The apparatus of claim 18, wherein:

said recess in said tool housing is an arcuate recess; and said arm of said framework means is an arcuate arm which fits within said arcuate recess when said framework means is in its said normal operating position.

23. The apparatus of claim 16, further comprising:

mounting means for detachably mounting said framework means on said tool housing so that said framework means and said control system can be completely separated from said tool housing without breaking apart said tool housing.

24. A downhole tool apparatus, comprising:

a cylindrical tool housing having a recess defined in an outer cylindrical surface thereof;

an operating assembly disposed in said housing;

a control system means, operably associated with said operating assembly, for detecting and responding to command signals transmitted as changes in well annulus pressure; and a control system framework means for housing said control system means, said framework means being received in said recess and detachably attached to said housing so that said framework means and said control system means can be completely separated from said tool housing without breaking apart a threaded joint of said housing.

25. The apparatus of claim 24, wherein:

said control system means includes a drive motor housed in said framework means and a valve spool attached to said drive motor and extending away from said framework means; and said tool housing has a valve bore defined therein, said valve spool being operably received in said valve bore.

26. The apparatus of claim 24, wherein:

said recess in said tool housing is an arcuate recess; and said framework means is arcuate in shape and is complementary to said arcuate means.

27. A method of controlling the operation of a downhole tool of the type having an operating mechanism normally operated in response to changes in well annulus pressure, said method comprising the steps of:

(a) transmitting a command signal;

(b) detecting said command signal at said tool;

(c) temporarily deactivating said operating mechanism of said tool in response to detection of said command signal so that said operating mechanism is no longer responsive to changes in well annulus pressure.

28. The method of claim 27, wherein:

said step (c) includes a step of balancing well annulus pressure across a power piston of said operating mechanism.

29. The method of claim 27, wherein:

said step (c) includes a step of isolating well annulus pressure from a power piston of said operating mechanism.

30. The method of claim 27, further comprising:

(d) transmitting a second command signal;

(e) detecting said second command signal at said tool;

(f) reactivating said operating mechanism of said tool so as to again be responsive to changes in well annulus pressure;

(g) changing well annulus pressure by a predetermined amount; and (h) operating said operating mechanism in response to step (g).

31. The method of claim 27, wherein:

said step (a) is further characterized as transmitting a predetermined pressure pulse down said well annulus, said pressure pulse being said command signal.

32. Downhole tool apparatus responds to the changes in pressure in a well annulus comprising:

a tool housing;

a power piston slidably disposed in said tool housing, said piston having a first side and a second side;

a first pressure conducting passage means, defined in said tool housing, for communicating said well annulus with said first side of said power piston;

reference pressure means, disposed in said tool housing, for providing a reference pressure communicated with said second side of said power piston, so that a change in well annulus pressure creates a pressure differential across said power piston to move said power piston between a first position and a second position relative to said tool housing;

a selective operable bypass means for temporarily bypassing changes in well annulus pressure around said reference pressure means, said bypass means including:

a bypass passage means, defined in said tool housing, for communicating said well annulus with said second side of said power piston; bypass valve means, disposed in said bypass passage means, for selectively opening and closing said bypass passage means as said bypass valve means is moved between an open position and a closed position; and control means for moving said bypass valve means between its open and closed positions, wherein said control means is further characterized as being responsive to changes in well annulus pressure and said bypass valve means is an electric motor operated bypass valve means; and said control means includes: a pressure sensor means for detecting changes in well annulus pressure; and microprocessor means for controlling said electric motor operated bypass valve means in response to a predetermined change in well annulus pressure detected by said pressure sensor means.

33. The apparatus of claim 32, wherein:

said electric motor operated bypass valve means is further characterized as requiring electric power only to selectively move said electric motor operated bypass valve means between its said open and closed position, so that said electric motor operated bypass valve means will remain in either its open or closed position without continued application of electric power thereto.

34. The apparatus of claim 32, wherein said control means further comprises:

an electric battery power supply; and said microprocessor means is further characterized as a means for causing said bypass valve means to remain in a predetermined one of its said open and closed positions upon sensing of a low power state of said power supply.

35. A downhole tool apparatus responsive to changes in pressure in a well annulus comprising:

a tool housing;

a power piston slidably disposed in said tool housing, said power piston having a first side and a second side; a first pressure conducting passage means to find in said tool housing, for communicating said well annulus pressure with said first side of said power piston; a second pressure conducting passage means, defined in said housing, for communicating said well annulus with said second side of said power piston;

a second pressure conductivity passage means, defined in said tool housing, for communicating said well annulus with said second side with said power piston;

reference pressure means, disposed in said tool housing, for providing a reference pressure communicated with said second side of said power piston, so that a change in well annulus pressure creates a pressure differential across said power piston to move said power piston between a first position and a second position relative to said tool housing, wherein said reference pressure means includes a retarding means, disposed in said second pressure conducting passage means, for delaying communication of a sufficient portion of a change in well annulus pressure to said second side of said power piston for a sufficient time to allow a pressure differential across said power piston to move said power piston between a first position and a second position relative to said housing; and selectively operable deactivating means for temporarily deactiving said power piston so that said power piston is no longer responsive to changes in well annulus pressure.

36. The apparatus of claim 35, wherein:

said bypass means has an open position wherein changes in well annulus pressure are substantially immediately communicated with said second side of said power piston and said power piston is not moved by changes in well annulus pressure, in a closed position wherein communication of changes in well annulus pressure through said second pressure conducting passage means to said second side of said power piston are delayed by said retarding means.

37. The apparatus of claim 36, wherein said bypass means comprises:

said second pressure conducting passage means having a bypass passage in hydraulic parallel with said retarding means;

bypass valve means, disposed in said bypass passage, for selectively opening and closing said bypass passage as said bypass valve means is moved between an open and a closed position corresponding to said open and closed positions of said bypass means; and control means for moving said bypass valve means between its said open and closed positions.

38. The apparatus of claim 35, wherein:

said retarding means includes a restricted orifice disposed in said second pressure conducting passage means.

39. A downhole tool apparatus responsive to changes in pressure in a well annulus comprising:

a tool housing;

a power piston slidably disposed in said tool housing, said piston having a first side and a second side;

a first pressure conducting passage means, defined in said tool housing, for communicating said well annulus with said first side of said power piston;

reference pressure means, disposed in said tool housing, for providing a reference pressure communicated with said second side of said power piston, so that a change in well annulus pressure creates a pressure differential across said power piston to move said power piston between a first position and a second position relative to said tool housing; and selectively operable deactivating means for temporarily deactivating said power piston so that said power piston is no longer responsive to changes in well annulus pressure and wherein said deactivating means is further characterized as requiring electrical power to selectively move said deactivating means between an activated and deactivated position thereof, so that said deactivating means will remain in either its activated or deactivated position without continued application of electrical power thereto.

40. A downhole tool apparatus, comprising:

an operating means for operating said apparatus in response to changes in well annulus pressure; and deactivating means for repeatedly selectively deactivating said operating means so that said operating means is no longer responsive to changes in well annulus pressure and for subsequently reactivating said operating means so that said operating means is again responsive to changes in well annulus pressure, wherein said deactivation means further includes:

an electrical battery power supply; and control means for causing said deactivation means to move to or remain in a predetermined one of a deactivated position and a reactivated position upon sensing of a low power state of said power supply.

41. A method of controlling the operation of a downhole tool of the type having an operating mechanism normally operated in response to changes in well annulus pressure, said operating mechanism being of the type having a power piston with a first side openly communicated with well annulus pressure and a second side communicated with well annulus pressure through a passage having a metering orifice disposed therein, said method comprising the steps of:

(a) transmitting a command signal;

(b) detecting said command signal at said tool; and (c) temporarily deactivating said operating mechanism of said tool in response to detection of said command signal so that said operating mechanism is no longer responsive to changes in well annulus pressure by bypassing said metering orifice and placing said second side of said power piston in an open communication with well annulus pressure.

* * * * *